US007005250B2

(12) United States Patent
Yokota et al.

(10) Patent No.: US 7,005,250 B2
(45) Date of Patent: Feb. 28, 2006

(54) SILVER HALIDE COLOR PHOTOGRAPHIC LIGHTSENSITIVE MATERIAL

(75) Inventors: Koichi Yokota, Minami-Ashigara (JP); Terukazu Yanagi, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/671,410

(22) Filed: Sep. 26, 2003

(65) Prior Publication Data

US 2004/0137386 A1 Jul. 15, 2004

(30) Foreign Application Priority Data

Sep. 30, 2002 (JP) ..... 2002-288064

(51) Int. Cl.
*G03C 1/38* (2006.01)
*G03C 1/815* (2006.01)
*G03C 1/85* (2006.01)
*G03C 7/392* (2006.01)

(52) U.S. Cl. ..... 430/501; 430/507; 430/512; 430/529; 430/634

(58) Field of Classification Search ..... 430/507, 430/512, 529, 634, 501
See application file for complete search history.

(56) References Cited

U.S. PATENT DOCUMENTS 4,347,308 A * 8/1982 Takeuchi et al.
4,968,599 A * 11/1990 Pitt et al.
5,254,448 A * 10/1993 Yamada et al.
5,503,967 A * 4/1996 Furlan et al.
6,589,723 B1 * 7/2003 Yamanouchi et al.
6,686,139 B1 * 2/2004 Kanazawa et al.
2003/0211430 A1 * 11/2003 Ikeda et al.

FOREIGN PATENT DOCUMENTS

JP 2141739 5/1990
JP 2002-255921 * 9/2002

* cited by examiner

*Primary Examiner*—Richard L. Schilling
(74) *Attorney, Agent, or Firm*—Sughrue Mion, PLLC

(57) ABSTRACT

A silver halide color photographic lightsensitive material comprising a support and, superimposed thereon, at least one blue-sensitive layer, at least one green-sensitive layer, at least one red-sensitive layer and at least one non-lightsensitive layer, wherein at least one fluorinated surfactant represented by the following general formula (A) or general formula (B) is contained and wherein a spectral sensitivity ratio at 370 nm as compared to that at 420 nm, which imparts the same density as that of the sensitivity at 420 nm in the spectral sensitivity distribution of the blue-sensitive layer, is 70% or less.

General Formula (A)

General formula (A)

General Formula (B)

General formula (B)

5 Claims, No Drawings

SILVER HALIDE COLOR PHOTOGRAPHIC LIGHTSENSITIVE MATERIAL

CROSS-REFERENCE TO RELATED APPLICATIONS

This application is based upon and claims the benefit of priority from the prior Japanese Patent Application No. 2002-288064, filed Sep. 30, 2002, the entire contents of which are incorporated herein by reference.

BACKGROUND OF THE INVENTION

1. Field of the Invention

The present invention relates to a silver halide color photographic lightsensitive material. More particularly, the present invention relates to a silver halide color photographic lightsensitive material which is not only excellent in antistatic effect but also has reduced crawling (cissing) occurring at the time of, for example, high-speed coating operation to thereby enable stable production thereof.

2. Description of the Related Art

Compounds having fluorinated alkyl chains are known as providing surfactants. Such surfactants can effect various surface modifications due to the peculiar properties (water repellency, oil repellency, lubricity, antistatic property, etc.) of the fluorinated alkyl chains, and are hence employed in the surface treatment of a wide variety of base materials, such as fibers, cloth, carpets and resins. Further, when a surfactant having fluorinated alkyl chain (hereinafter referred to as "fluorinated surfactant") is added to an aqueous medium solution of substrate of varied type, not only can a uniform coating film free from crawling be formed at the time of coating film formation but also an adsorption layer of surfactant can be formed on the surface of the substrate to thereby cause the surface of coating film to have the above peculiar properties of fluorinated alkyl chains.

In photographic lightsensitive materials as well, various surfactants are employed and play important rolls. The photographic lightsensitive materials are generally produced by coating a support with a plurality of coating liquids each containing an aqueous solution of hydrophilic colloid binder (for example, gelatin) in sequence so as to form a plurality of layers. However, frequently, the formation of a plurality of hydrophilic colloid layers is performed by simultaneous multilayer coating operation. These layers include an antistatic layer, a subbing layer, an antihalation layer, silver halide emulsion layers, interlayers, a filter layer, a protective layer, etc. These layers are loaded with various materials for exerting their respective functions. Further, the hydrophilic colloid layers may be loaded with polymer latexes for enhancing the physical properties of films. Still further, in order to attain the incorporation of functional compounds of sparing water solubility, such as a color coupler, an ultraviolet absorber, a fluorescent whitening agent and a slip agent, into hydrophilic colloid layers, these compounds directly or after dissolution in a high-boiling-point organic solvent, such as a phosphoric ester compound or a phthalic ester compound, may be emulsified and dispersed in a hydrophilic colloid solution and used to prepare coating liquids. Thus, the photographic lightsensitive materials are generally each composed of various hydrophilic colloid layers, and at the production thereof, it is required to carry out uniform high-speed application of coating liquids containing various materials without defects, such as crawling and coating unevenness. For meeting such requirement, it is often effected to add a surfactant as a coating auxiliary to coating liquids.

On the other hand, the photographic lightsensitive materials are brought into contact with various materials during the production, use for photographing and development processing thereof. For example, when a lightsensitive material is in wound form during the processing, the back layer formed on the back side of the support may be brought into contact with the surface layer. Further, while being conveyed during the processing, the lightsensitive material may be brought into contact with stainless steel, rubber rollers, etc. When brought into contact with these materials, the lightsensitive material at the surface (gelatin layer) thereof is likely to have positive charge and occasionally induces unwanted discharge with the result that undesirable exposure marks (known as static marks) remain on the cclightsensitive material. Compounds having fluorine atoms are effective in reducing of the charging of gelatin, and hence a fluorinated surfactant is often added thereto.

The sensitivity in the ultraviolet region is determined by a specific sensitivity of a silver halide emulsion, a gelatin used as a dispersant, and materials having absorptions in the ultraviolet region, including an ultraviolet absorber. Incorporating of a non-lightsensitive silver halide emulsion, a gelatin, an ultraviolet absorber, a hydrophilic colloid dispersion, etc. in a protective layer so as to control the spectral sensitivity of the ultraviolet region is known as a means for reducing undesirable exposure marks on the lightsensitive material even if unwanted discharging occurs, while incorporating of these materials in the protective layer would affect the uniformity of coating film at the time of high-speed coating operation and cause crawling and unevenness, thereby limiting a productivity increase. In view of the encountered difficulty in required simultaneous accomplishment of charging characteristics and high-speed coatability, it is vital to develop a surfactant, in particular, fluorinated surfactant that realizes excellent charging characteristics and high-speed coatability.

As mentioned above, surfactants, in particular, fluorinated surfactants have been employed as a coating aid for realizing the uniformity of coating film or as a material capable of simultaneously realizing the uniformity and the prevention of charging with respect to photographic lightsensitive materials. Examples thereof are disclosed in, for example, the following patent literature: Jpn. Pat. Appln. KOKAI Publication No. (hereinafter referred to as JP-A-) 49-46733, and JP-A's 51-32322, 57-64228, 64-536, 2-141739, 3-95550 and 4-248543, However, the disclosed surfactants do not necessarily exhibit satisfactory properties in view of the demand of recent years on the sensitivity enhancement and high-speed coating operation with respect to photographic lightsensitive materials. The disclosed surfactants are those which limit the use of ultraviolet absorber so as to be unable to satisfactorily attain a sensitivity decrease in the ultraviolet region. Therefore, there is a demand on achieving of further improvement leading to development of a fluorinated surfactant being excellent in charging characteristics and high-speed coatability and thus providing a lightsensitive material wherein the sensitivity decrease in the ultraviolet region has also been attained.

BRIEF SUMMARY OF THE INVENTION

It is an object of the present invention to provide a silver halide photographic lightsensitive material which can stably be produced and which is excellent in antistatic performance and high-speed coatability.

As a result of extensive and intensive studies, the inventors have enabled providing a lightsensitive material being excellent in charging characteristics and high-speed coatability by the following means.

(1) A silver halide color photographic lightsensitive material comprising a support and, superimposed thereon, at least one blue-sensitive layer, at least one green-sensitive layer, at least one red-sensitive layer and at least one non-lightsensitive layer, wherein at least one fluorinated surfactant represented by the following general formula (A) or general formula (B) is contained and wherein a spectral sensitivity ratio at 370 nm as compared to that at 420 nm, which imparts the same density as that of the sensitivity at 420 nm in the spectral sensitivity distribution of the blue-sensitive layer, is 70% or less.

General Formula (A)

General formula (A)

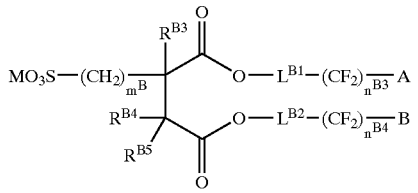

In the general formula (A), each of $R^{B3}$, $R^{B4}$ and $R^{B5}$ independently represents a hydrogen atom or a substituent. Each of A and B independently represents a fluorine atom or a hydrogen atom. Each of $n^{B3}$ and $n^{B4}$ is independently an integer of 4 to 8. Each of $L^{B1}$ and $L^{B2}$ independently represents a substituted or unsubstituted alkylene group, a substituted or unsubstituted alkyleneoxy group, or a bivalent connecting group composed of a substituted or unsubstituted alkylene group combined with a substituted or unsubstituted alkyleneoxy group. $m^B$ is 0 or 1. M represents a cation.

General Formula (B)

General formula (B)

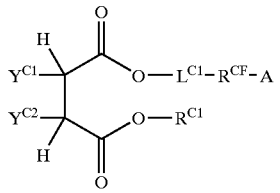

In the general formula (B), $R^{C1}$ represents a substituted or unsubstituted alkyl group excluding a fluorinated alkyl group. $R^{CF}$ represents a perfluoroalkylene group. A represents a hydrogen atom or a fluorine atom. $L^{C1}$ represents a substituted-or unsubstituted alkylene group, a substituted or unsubstituted alkyleneoxy group, or a bivalent connecting group composed of a substituted or unsubstituted alkylene group combined with a substituted or unsubstituted alkyleneoxy group. One of $Y^{C1}$ and $Y^{C2}$ represents a hydrogen atom while the other represents $-L^{C2}-SO_3M$ in which M represents a cation and $L^{C2}$ represents a single bond or a substituted or unsubstituted alkylene group.

(2) The silver halide color photographic lightsensitive material according to item (1), wherein the spectral sensitivity ratio is 60% or less.

(3) The silver halide color photographic lightsensitive material according to item (1), wherein the spectral sensitivity ratio is 50% or less.

(4) The silver halide color photographic lightsensitive material according to item (1), wherein the spectral sensitivity ratio is 30% or less.

(5) The silver halide color photographic lightsensitive material according to any one of items (1) to (4), wherein the compound represented by the general formula (A) is contained as said at least one fluorinated surfactant.

(6) The silver halide color photographic lightsensitive material according to any one of items (1) to (5), wherein it is in the fort of a roll film,

DETAILED DESCRIPTION OF THE INVENTION

The fluorinated surfactant represented by the general formula (A) or general formula (B) will be described in detail below.

First, the compound represented by the following general formula (A) will be described in detail.

General Formula (A)

General formula (A)

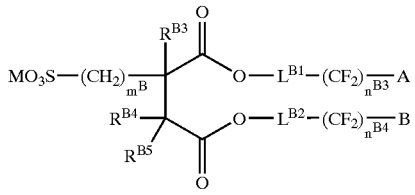

In the general formula (A), each of $R^{B3}$, $R^{B4}$ and $R^{B5}$ independently represents a hydrogen atom or a substituent. Each of A and B independently represents a fluorine atom or a hydrogen atom. Each of $n^{B3}$ and $n^{B4}$ is independently an integer of 4 to 8. Each of $L^{B1}$ and $L^{B2}$ independently represents a substituted or unsubstituted alkylene group, a substituted or unsubstituted alkyleneoxy group, or a bivalent connecting group composed of a substituted or unsubstituted alkylene group combined with a substituted or unsubstituted alkyleneoxy group. $m^B$ is 0 or 1. M represents a cation.

In the general formula (A), each of $R^{B3}$, $R^{B4}$ and $R^{B5}$ independently represents a hydrogen atom or a substituent. Any of the substituents (T) described later can be used as the substituent.

Each of $R^{B3}$, $R^{B4}$ and $R^{B5}$ preferably represents an alkyl group or a hydrogen atom; more preferably an alkyl group having 1 to 12 carbon atoms or a hydrogen atom; still more preferably a methyl group or a hydrogen atom; and most preferably a hydrogen atom.

In the general formula (A), each of A and B independently represents a fluorine atom or a hydrogen atom. Preferably, A and B simultaneously represent a fluorine atom or a hydrogen atom. More preferably, A and B simultaneously represent a fluorine atom.

In the general formula (A), each of $n^{B3}$ and $n^{B4}$ is independently an integer of 4 to 8. Preferably, each of $n^{B3}$ and $n^{B4}$ is an integer of 4 to 6 and $n^{B3}=n^{B4}$. More preferably, each of $n^{B3}$ and $n^{B4}$ is an integer of 4 or 6 and $n^{B3}=n^{B4}$. Most preferably, $n^{B3}=n^{B4}=4$.

In the general formula (A), $m^B$ is 0 or 1, either equally preferred.

In the general formula (A), each of $L^{B1}$ and $L^{B2}$ independently represents a substituted or unsubstituted alkylene group, a substituted or unsubstituted alkyleneoxy group, or a bivalent connecting group composed of a substituted or unsubstituted alkylene group combined with a substituted or unsubstituted alkyleneoxy group. Any of the substituents (T) described later can be used as the substituent. Each of $L^{B1}$ and $L^{B2}$ is preferably a group having 4 or less carbon atoms, and is preferably an unsubstituted alkylene.

M represents a cation. As the cation represented by M, preferred use is made of, for example, an alkali metal ion (lithium ion, sodium ion, potassium ion, etc.), an alkaline earth metal ion (barium ion, calcium ion, etc.), or ammonium ion. Lithium ion, sodium ion, potassium ion and ammonium ion are preferred. Lithium ion, sodium ion and potassium ion are more preferred. Sodium ion is most preferred.

Among the compounds of the above general formula (A), compounds of the following general formula (A-1) are preferred.

General Formula (A-1)

general formula (A-1)

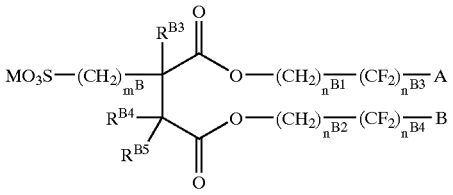

In the general formula (A-1), $R^{B3}$, $R^{B4}$, $R^{B5}$, $n^{B3}$, $n^{B4}$, $m^B$, A, B and M are as defined above with respect to the general formula (A), Preferred ranges thereof are also the sate as mentioned above. Each of $n^{B1}$ and $n^{B2}$ is independently an integer of 1 to 6.

In the general formula (A-1), each of $n^{B1}$ and $n^{B2}$ is independently an integer of 1 to 6. Preferably, each of $n^{B1}$ and $n^{B2}$ is an integer of 1 to 6 and $n^{B1}=n^{B2}$. More preferably, each of $n^{B1}$ and $n^{B2}$ is an integer of 1 to 4 and $n^{B1}=n^{B2}$. Still more preferably, each of $n^{B1}$ and $n^{B2}$ is an integer of 2 or 3 and $n^{B1}=n^{B2}$. Most preferably, $n^{B1}=n^{B2}=2$.

Among the compounds of the above general formula (A), compounds of the following general formula (A-2) are more preferred.

General Formula (A-2)

General formula (A-2)

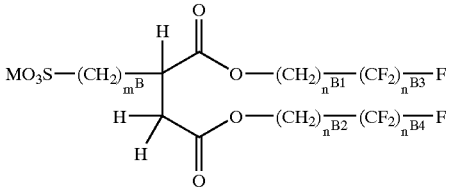

In the general formula (A-2), $n^{B3}$, $n^{B4}$, $m^B$ and M are as defined above with respect to the general formula (A). Preferred ranges thereof are also the same as mentioned above. In the general formula (A-2), $n^{B1}$ and $n^{B2}$ are as defined above with respect to the general formula (A-1). Preferred ranges thereof are also the same as mentioned above.

Among the compounds of the above general formula (A), compounds of the following general formula (A-3) are still more preferred.

General Formula (A-3)

General formula (A-3)

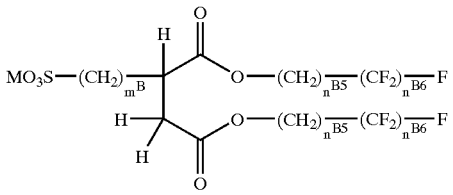

In the general formula (A-3), $n^{B5}$ is 2 or 3, and $n^{B6}$ is an integer of 4 to 6. $m^B$ is 0 or 1, either equally preferred. M is as defined above with respect to the general formula (A). Preferred range thereof is also the same as mentioned above.

Specific examples of the compounds of the above general formula (A) (FS-201 to FS-241) will be shown below, which however in no way limit the scope of the present invention.

FS-201

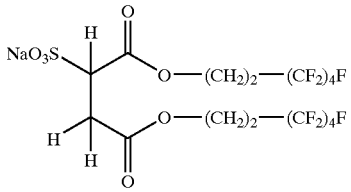

FS-202

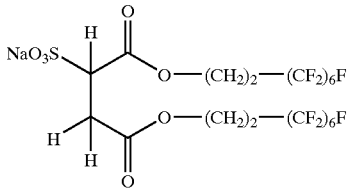

FS-203

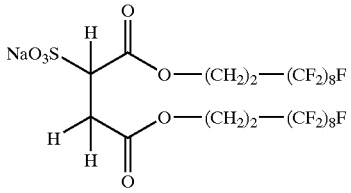

FS-204

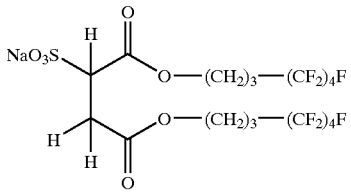

-continued
FS-205
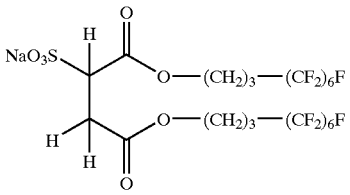
FS-206
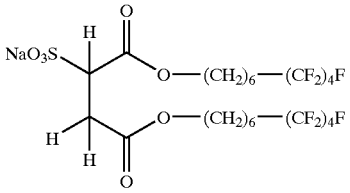
FS-207
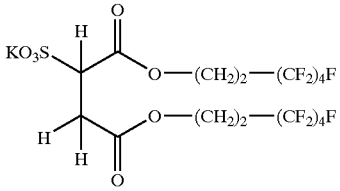
FS-208
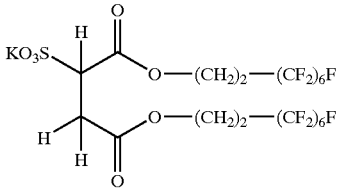
FS-209
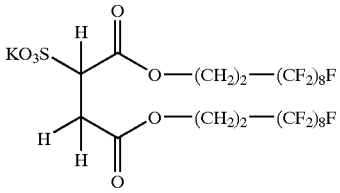
FS-210
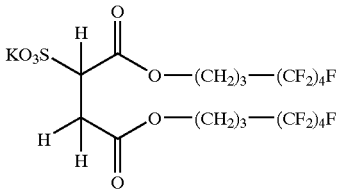
FS-211
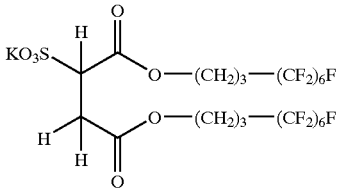
FS-212
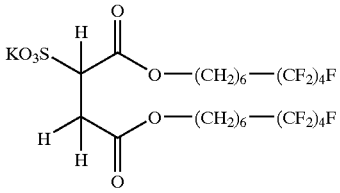
-continued
FS-213
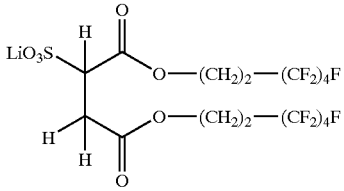
FS-214
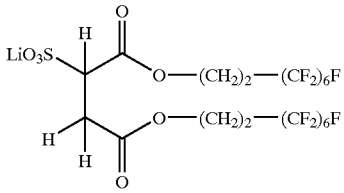
FS-215
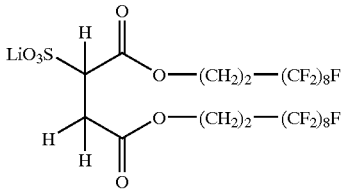
FS-216
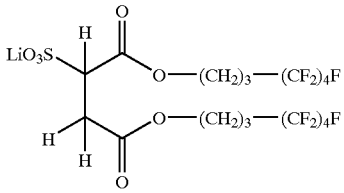
FS-217
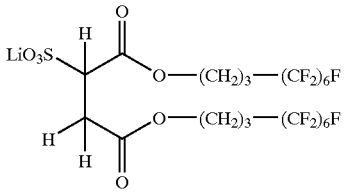
FS-218
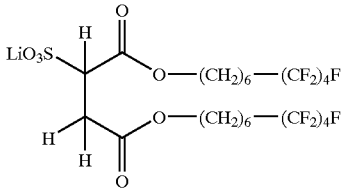
FS-219
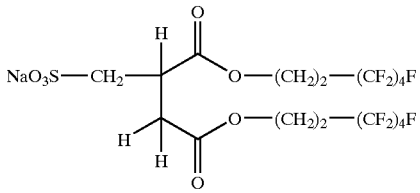
FS-220
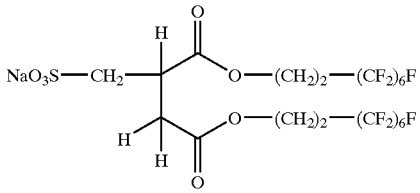

-continued
FS-221
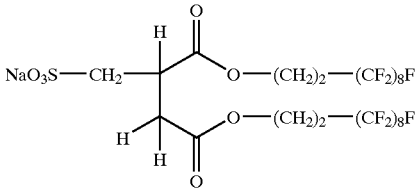
FS-222
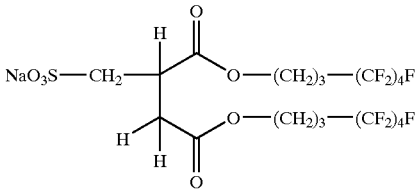
FS-223
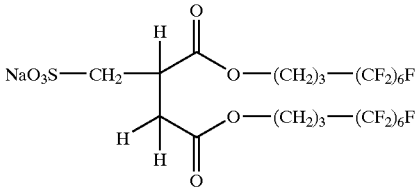
FS-224
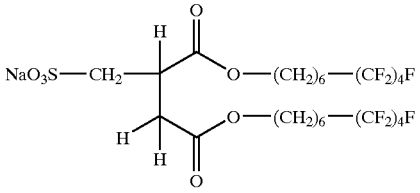
FS-225
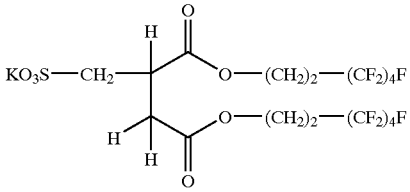
FS-226
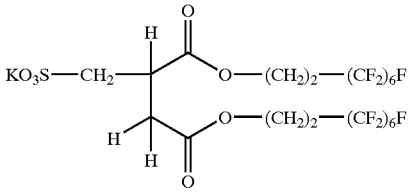
FS-227
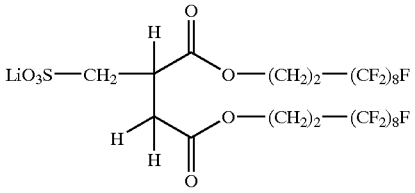
-continued
FS-228
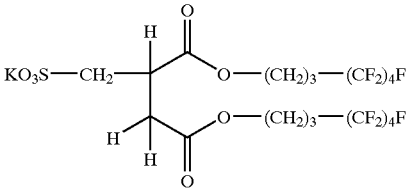
FS-229
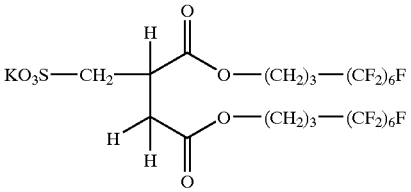
FS-230
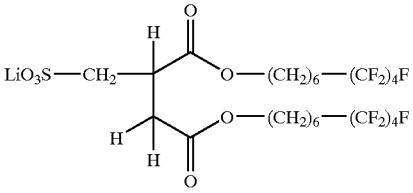
FS-231
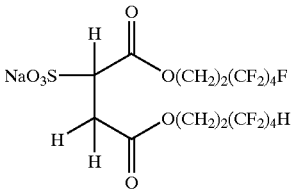
FS-232
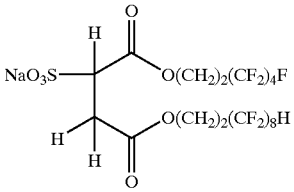
FS-233
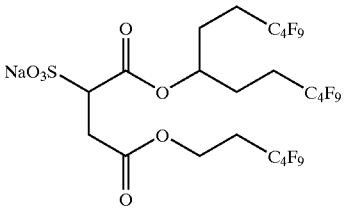
FS-234
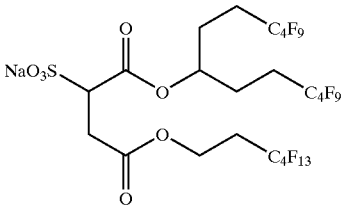

-continued

FS-235

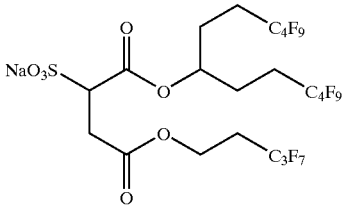

FS-236

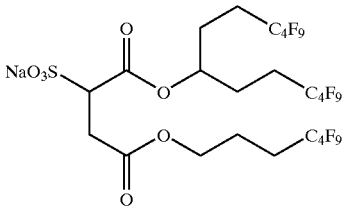

FS-237

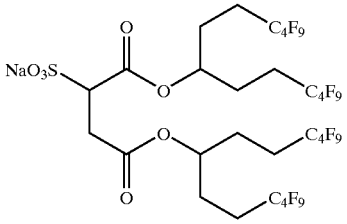

FS-238

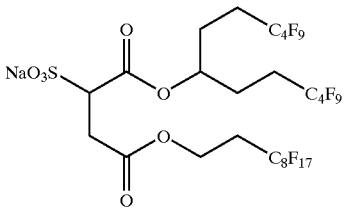

FS-239

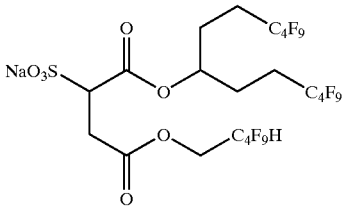

FS-240

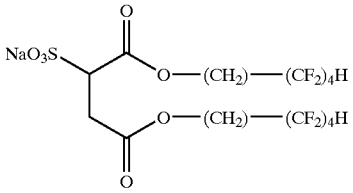

FS-241

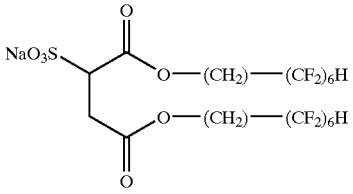

-continued

FS-242

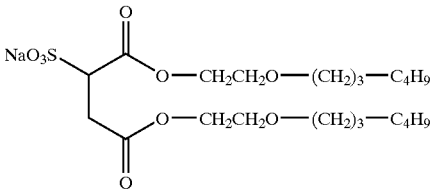

FS-243

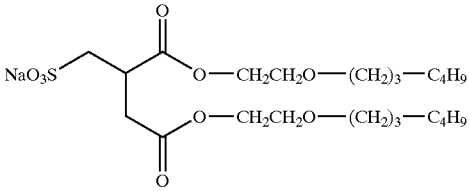

FS-244

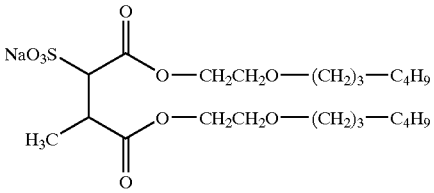

The compounds of the above general formula (A) can be easily synthesized by the use of common esterification reaction and sulfonation reaction in combination. The conversion of counter cation can be easily accomplished by the use of an ion exchange resin. Examples of representative synthetic methods will be described below, which however in no way limit the scope of the present invention.

SYNTHETIC EXAMPLE 1

Synthesis of Compound FS-201

1-1 Synthesis of di(3,3,4,4,5,5,6,6,6-nonafluorohexyl) Maleate 90.5 g (0.924 mol) of maleic anhydride, 500 g (1.89 mol) of 3,3,4,4,5,5,6,6,6-nonafluorohexanol and 17.5 g (0.09 mol) of p-toluenesulfonic acid monohydrate were heated in 250 mL of toluene under reflux while distilling off formed water for 20 hr. The thus obtained reaction mixture was cooled to room temperature, and toluene was added thereto. The organic phase was washed with water, and the solvent was distilled off in vacuum, thereby obtaining 484 g of desired product (yield 86%) as a transparent liquid.

1-2 Synthesis of Compound FS-201

514 g (0.845 mol) of di(3,3,4,4,5,5,6,6,6-nonafluorohexyl)maleate, 91.0 g (0.875 mol) of sodium hydrogen sulfite and 250 mL of water/ethanol (1/1 v/v) were mixed together, and heated under reflux for 6 hr. 500 mL of ethyl acetate and 120 mL of a saturated aqueous solution of sodium chloride were added to the mixture, and an extraction was effected. The organic phase was recovered, and sodium sulfate was added so as to dehydrate the organic phase. Sodium sulfate was removed by filtration, and the filtrate was concentrated. 2.5 L of acetone was added to the concentrate, and heated. Undissolved matter was filtered off, and the solution was cooled to 0° C. 2.5 L of acetonitrile was slowly added to effect precipitation. Precipitated solid was collected by filtration, and obtained crystal was dried in vacuum at 80° C. As a result, 478 g (yield 79%) of desired compound as white crystal was obtained. $^1$H-NMR data of the obtained compound are as follows:

$^1$H-NMR (DMSO-$d_6$) δ 2.49–2,62 (m, 4H), 2.85–2.99 (m, 2H), 3.68 (dd, 1H), 4.23–4.35 (m, 4H)

Now, the compounds of the general formula (B) will be described in detail.

General Formula (B)

General formula (B)

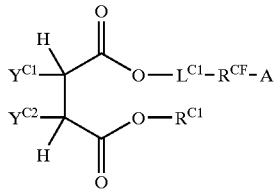

In the general formula (B), $R^{C1}$ represents a substituted or unsubstituted alkyl group excluding a fluorinated alkyl group. $R^{CF}$ represents a perfluoroalkylene group. A represents a hydrogen atom or a fluorine atom. $L^{C1}$ represents a substituted or unsubstituted alkylene group, a substituted or unsubstituted alkyleneoxy group, or a bivalent connecting group composed of a combination thereof. One of $Y^{C1}$ and $Y^{C2}$ represents a hydrogen atom while the other represents $-L^{C2}-SO_3$ in which M represents a cation.

In the general formula (B), $R^{C1}$ represents a substituted or unsubstituted alkyl group. The substituted or unsubstituted alkyl group represented by $R^{C1}$ may be linear, or may be in the form of a branched chain, or may have a cyclic structure, Any of the substituents (T) described later can be used as the substituent. As the substituent, there can preferably be mentioned an alkenyl group, an aryl group, an alkoxy group, a halogen atom (more preferably C1), a carboxylic ester group, a carbonamido group, a carbamoyl group, an oxycarbonyl group, a phosphoric ester group or the like.

$R^{C1}$ preferably represents an unsubstituted alkyl group, more preferably an unsubstituted alkyl group having 2 to 24 carbon atoms, still more preferably an unsubstituted alkyl group having 4 to 24 carbon atoms, and most preferably an unsubstituted alkyl group having 6 to 20 carbon atoms.

$R^{CF}$ represents a perfluoroalkylene group. Herein, the perfluoroalkylene group refers to an alkylene group having all the hydrogen atoms thereof replaced by fluorine. The perfluoroalkylene group may be linear, or may be in the form of a branched chain, or may have a cyclic structure. $R^{CF}$ preferably has 1 to 10 carbon atoms, more preferably 1 to 8 carbon atoms.

A represents a hydrogen atom or a fluorine atom. A fluorine atom is preferred.

$L^{C1}$ represents a substituted or unsubstituted alkylene group, a substituted or unsubstituted alkyleneoxy group, or a bivalent connecting group composed of a combination thereof. The substituent can be any of those of preferred range which have been mentioned above with respect to $R^{C1}$. $L^{C1}$ preferably has 4 or less carbon atoms, and it is preferred that $L^{C1}$ represent an unsubstituted alkylene.

One of $Y^{C1}$ and $Y^{C2}$ represents a hydrogen atom while the other represents $-L^{C2}-SO_3M$ in which M represents a cation. As the cation represented by M, preferred use is made of, for example, an alkali metal ion (lithium ion, sodium ion, potassium ion, etc.), an alkaline earth metal ion (barium ion, calcium ion, etc.), or ammonium ion. Lithium ion, sodium ion, potassium ion and ammonium ion are more preferred. Lithium ion, sodium ion and potassium ion are still more preferred. Appropriate cation can be selected depending on the total number of carbons, substituent, degree of alkyl branching, etc. with respect to the compound of the above general formula (B). When the total number of carbons had by $R^{C1}$, $R^{CF}$ and $L^{C1}$ is 16 or greater, the employment of lithium ion is advantageous from the viewpoint of simultaneous attainment of solubility (especially in water) and antistatic capability or coating uniformity.

$L^{C2}$ represents a single bond or a substituted or unsubstituted alkylene group. The substituent can be any of those of preferred range which have been mentioned above with respect to $R^{C1}$.

$L^{C2}$ preferably represents a single bond or an alkylene group having 2 or less carbon atoms, more preferably a single bond or an unsubstituted alkylene group, and still more preferably a single bond or a methylene group. Most preferably, $L^{C2}$ represents a single bond.

Among the compounds of the above general formula (B), compounds of the following general formula (B-1) are preferred.

General Formula (B-1)

General formula (B-1)

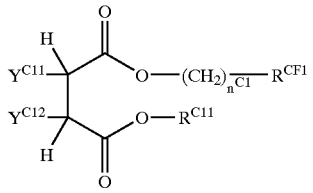

In the general formula (B-1), $R^{C11}$ represents a substituted or unsubstituted alkyl group whose total number of carbon-atoms is 6 or greater. $R^{CF1}$ represents a perfluoroalkyl group having 6 or less carbon atoms. One of $Y^{C11}$ and $Y^{C12}$ represents a hydrogen atom while the other represents $SO^3M^C$ in which $M^C$ represents a cation. $n^{C1}$ is an integer of 1 or greater.

In the general formula (B-1), $R^{C11}$ represents a substituted or unsubstituted alkyl group whose total number of carbon atoms is 6 or greater, provided that $R^{C11}$ is not a fluorinated alkyl group. The substituted or unsubstituted alkyl group represented by $R^{C11}$ may be linear, or may be in the form of a branched chain, or may have a cyclic structure. As the substituent, there can be mentioned an alkenyl group, an aryl group, an alkoxy group, a halogen atom excluding fluorine, a carboxylic ester group, a carbonamido group, a carbamoyl group, an oxycarbonyl group, a phosphoric ester group or the like.

The total number of carbon atoms of the substituted or unsubstituted alkyl group represented by $R^{C11}$ is preferably in the range of 6 to 24. Preferred examples of the unsubstituted alkyl groups having 6 to 24 carbon atoms include n-hexyl, n-heptyl, n-octyl, tert-octyl, 2-ethylhexyl, n-nonyl, 1,1,3-trimethylhexyl, n-decyl, n-dodecyl, cetyl, hexadecyl, 2-hexyldecyl, octadecyl, eicosyl, 2-octyldodecyl, docosyl, tetracosyl, 2-decyltetradecyl, tricosyl, cyclohexyl, cycloheptyl and the like. Preferred examples of the substituted alkyl groups whose total number of carbon atoms, inclusive of the carbon atoms of substituent, is in the range of 6 to 24 include 2-hexenyl, oleyl, linoleyl, linolenyl, benzyl, (bt)-phenethyl, 2-methoxyethyl, 4-phenylbutyl, 4-acetoxyethyl, 6-phenoxyhexyl, 12-phenyldodecyl, 18-phenyloctadecyl, 12-(p-chlorophenyl)dodecyl, 2-(phosphatodiphenyl)ethyl and the like.

The total number of carbon atoms of the substituted or unsubstituted alkyl group represented by $R^{C11}$ is more preferably in the range of 6 to 18. Preferred examples of the unsubstituted alkyl groups having 6 to 18 carbon atoms include n-hexyl, cyclohexyl, n-heptyl, n-octyl, tert-octyl, 2-ethylhexyl, n-nonyl, 1,1,3-trimethylhexyl, n-decyl, n-dodecyl, cetyl, hexadecyl, 2-hexyldecyl, octadecyl, 4-tert-butylcyclohexyl and the like. Preferred examples of the substituted alkyl groups whose total number of carbon atoms, inclusive of the carbon atoms of substituent, is in the range of 6 to 18 include phenethyl, 6-phenoxyhexyl, 12-phenyldodecyl, oleyl, linoleyl, linolenyl and the like. Still more preferably, $R^{C11}$ represents n-hexyl, cyclohexyl, n-heptyl, n-octyl, 2-ethylhexyl, n-nonyl, 1,1,3-trimethylhexyl, n-decyl, n-dodecyl, cetyl, hexadecyl, 2-hexyldecyl, octadecyl, oleyl, linoleyl or linolenyl. It is most preferred that $R^{C11}$ represent a linear, cyclic or branched unsubstituted alkyl group having 8 to 16 carbon atoms.

In the general formula (B-1), $R^{CF1}$ represents a perfluoroalkyl group having 6 or less carbon atoms. Herein, the perfluoroalkyl group refers to an alkyl group having all the hydrogen atoms thereof replaced by fluorine. The alkyl of the perfluoroalkyl group may be linear, or may be in the form of a branched chain, or may have a cyclic structure. The perfluoroalkyl group represented by $R^{CF1}$ can be, for example, any of trifluoromethyl, pentafluoroethyl, heptafluoro-n-propyl, heptafluoroisopropyl, nonafluoro-n-butyl, undecafluoro-n-pentyl, tridecafluoro-n-hexyl, undecafluorocyclohexyl and the like. Of these, perfluoroalkyl groups having 2 to 4 carbon atoms (e.g., pentafluoroethyl, heptafluoro-n-propyl, heptafluoroisopropyl and nonafluoro-n-butyl) are preferred. Heptafluoro-n-propyl and nonafluoro-n-butyl are most preferred.

In the general formula (B-1), $n^{C1}$ is an integer of 1 or greater, preferably an integer of 1 to 4, and most preferably 1 or 2.

With respect to combinations of $n^{C1}$ and $R^{CF1}$, it is preferred that when $n^{C1}=1$, $R^{CF1}$ be heptafluoro-n-propyl or nonafluoro-n-butyl, and that when $n^{C1}=2$, $R^{CF1}$ be nonafluoro-n-butyl.

In the general formula (B-1), one of $Y^{C11}$ and $Y^{C12}$ represents a hydrogen atom while the other represents $SO^3M^C$ in which $M^C$ represents a cation. As the cation represented by $M^C$, preferred use is made of, for example, an alkali metal ion (lithium ion, sodium ion, potassium ion, etc.), an alkaline earth metal ion (barium ion, calcium ion, etc.), or ammonium ion. Among these, lithium ion, sodium ion, potassium ion and ammonium ion are more preferred. Sodium ion is most preferred.

The substituent (T) mentioned in the above description of general formulae will be described below.

The substituent (T) can be, for example, any of an alkyl group (preferably having 1 to 20 carbon atoms, more preferably 1 to 12 carbon atoms and most preferably 1 to 8 carbon atoms; e.g., methyl, ethyl, isopropyl, tert-butyl, n-octyl, n-decyl, n-hexadecyl, cyclopropyl, cyclopentyl or cyclohexyl), an alkenyl group (preferably having 2 to 20 carbon atoms, more preferably 2 to 12 carbon atoms and most preferably 2 to 8 carbon atoms; e.g., vinyl, allyl, 2-butenyl or 3-pentenyl), an alkynyl group (preferably having 2 to 20 carbon atoms, more preferably 2 to 12 carbon atoms and most preferably 2 to 8 carbon atoms; e.g., propargyl or 3-pentynyl), an aryl group (preferably having 6 to 30 carbon atoms, more preferably 6 to 20 carbon atoms and most preferably 6 to 12 carbon atoms; e.g., phenyl, p-methylphenyl or naphthyl), a substituted or unsubstituted amino group (preferably having 0 to 20 carbon atoms, more preferably 0 to 10 carbon atoms and most preferably 0 to 6 carbon atoms; e.g., unsubstituted amino, methylamino, dimethylamino, diethylamino or dibenzylamino), an alkoxy group (preferably having 1 to 20 carbon atoms, more preferably 1 to 12 carbon atoms and most preferably 1 to 8 carbon atoms; e.g., methoxy, ethoxy or butoxy), an aryloxy group (preferably having 6 to 20 carbon atoms, more preferably 6 to 16 carbon atoms and most preferably 6 to 12 carbon atoms; e.g., phenyloxy or 2-naphthyloxy), an acyl group (preferably having 1 to 20 carbon atoms, more preferably 1 to 16 carbon atoms and most preferably 1 to 12 carbon atoms; e.g., acetyl, benzoyl, formyl or pivaloyl), an alkoxycarbonyl group (preferably having 2 to 20 carbon atoms, more preferably 2 to 16 carbon atoms and most preferably 2 to 12 carbon atoms; e.g., methoxycarbonyl or ethoxycarbonyl), an aryloxycarbonyl group (preferably having 7 to 20 carbon atoms, more preferably 7 to 16 carbon atoms and most preferably 7 to 10 carbon atoms; e.g., phenyloxycarbonyl), an acyloxy group (preferably having 2 to 20 carbon atoms, more preferably 2 to 16 carbon atoms and most preferably 2 to 10 carbon atoms; e.g., acetoxy or benzoyloxy), an acylamino group (preferably having 2 to 20 carbon atoms, more preferably 2 to 16 carbon atoms and most preferably 2 to 10 carbon atoms; e.g., acetylamino or benzoylamino), an alkoxycarbonylamino group (preferably having 2 to 20 carbon atoms, more preferably 2 to 16 carbon atoms and most preferably 2 to 12 carbon atoms; e.g., methoxycarbonylamino), an aryloxycarbonylamino group (preferably having 7 to 20 carbon atoms, more preferably 7 to 16 carbon atoms and most preferably 7 to 12 carbon atoms; e.g., phenyloxycarbonylamino), a sulfonylamino group (preferably having 1 to 20 carbon atoms, more preferably 1 to 16 carbon atoms and most preferably 1 to 12 carbon atoms; e.g., methanesulfonylamino or benzenesulfonylamino), a sulfamoyl group (preferably having 0 to 20 carbon atoms, more preferably 0 to 16 carbon atoms and most preferably 0 to 12 carbon atoms; e.g., sulfamoyl, methylsulfamoyl, dimethylsulfamoyl or phenylsulfamoyl), a carbamoyl group (preferably having 1 to 20 carbon atoms, more preferably 1 to 16 carbon atoms and most preferably 1 to 12 carbon atoms; e.g., unsubstituted carbamoyl, methylcarbamoyl, diethylcarbamoyl or phenylcarbamoyl), an alkylthio group (preferably having 1 to 20 carbon atoms, more preferably 1 to 16 carbon atoms and most preferably 1 to 12 carbon atoms; e.g., methylthio or ethylthio), an arylthio group (preferably having 6 to 20 carbon atoms, more preferably 6 to 16 carbon atoms and most preferably 6 to 12 carbon atoms; e.g., phenylthio), a sulfonyl group (preferably having 1 to 20 carbon atoms, more preferably 1 to 16 carbon atoms and most preferably 1 to 12 carbon atoms; e.g., mesyl or tosyl), a sulfinyl group (preferably having 1 to 20 carbon atoms, more preferably 1 to 16 carbon atoms and most preferably 1 to 12 carbon atoms; e.g., methanesulfinyl or benzenesulfinyl), a ureido group (preferably having 1 to 20 carbon atoms, more preferably 1 to 16 carbon atoms and most preferably 1 to 12 carbon atoms; e.g., unsubstituted ureido, methylureido or phenylureido), a phosphoramido group (preferably having 1 to 20 carbon atoms, more preferably 1 to 16 carbon atoms and most preferably 1 to 12 carbon atoms; e.g., diethylphosphoramido or phenylphosphoramido), a hydroxyl group, a mercapto group, a halogen atom (e.g., fluorine atom, chlorine atom, bromine atom or iodine atom), a cyano group, a sulfo group, a carboxyl group, a nitro group, a hydroxamic acid group, a sulfino group, a hydrazino group, an imino group, a heterocyclic group (preferably having 1 to 30 carbon atoms, more preferably 1 to 12 carbon atoms, and containing a heteroatom such as a nitrogen atom, an oxygen atom or a sulfur atom; e.g., imidazolyl, pyridyl, quinolyl, furyl, piperidyl, morpholino, benzoxazolyl, benzimidazoyl or benzthiazolyl) and a silyl group (preferably having 3 to 40 carbon atoms, more preferably 3 to 30 carbon atoms and most preferably 3 to 24 carbon atoms; e.g., trimethylsilyl or triphenylsilyl). These substituents may have further substituents. In the use of a plurality of substituents, they may be identical with or different from each other. Moreover, if appropriate, the substituents may be cycled.

Specific examples (FS-301 to FS-335) of the compounds of the above general formula (B) will be shown below, which however in no way limit the scope of the present invention.

FS-301

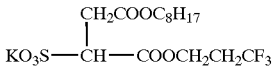

FS-302

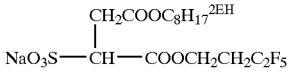

FS-303

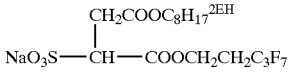

FS-304

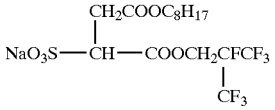

FS-305

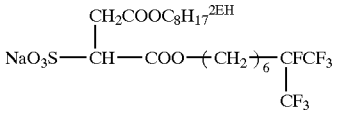

FS-306

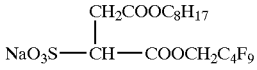

FS-307

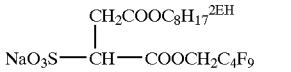

FS-308

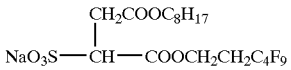

FS-309

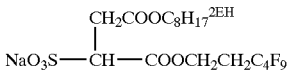

FS-310

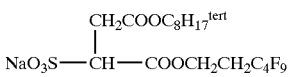

FS-311

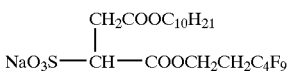

FS-312

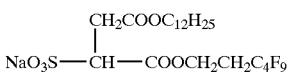

FS-313

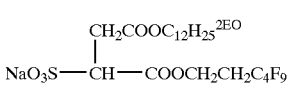

-continued

FS-314

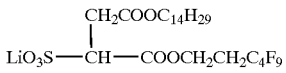

FS-315

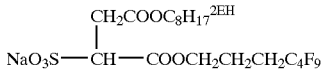

FS-316

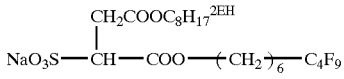

FS-317

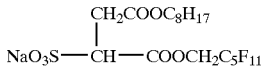

FS-318

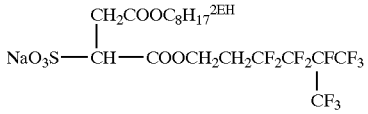

FS-319

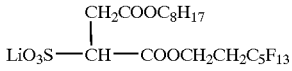

FS-320

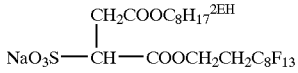

FS-321

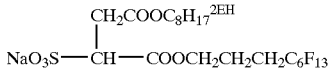

FS-322

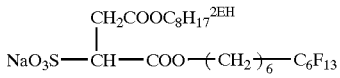

FS-323

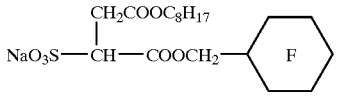

FS-324

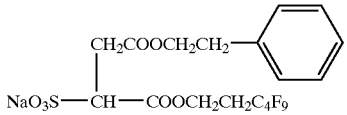

FS-325

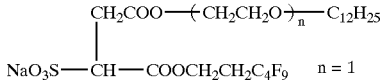

FS-326

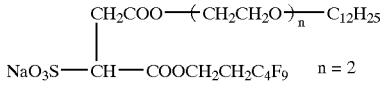

FS-327

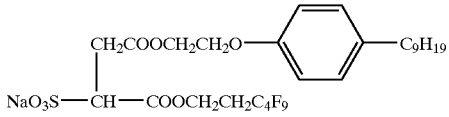

FS-328

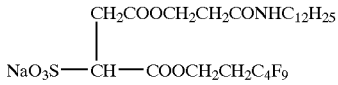

-continued

FS-329

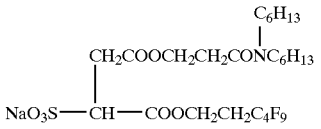

FS-330

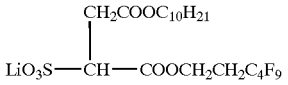

FS-331

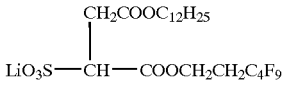

FS-332

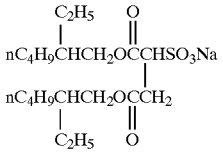

FS-333

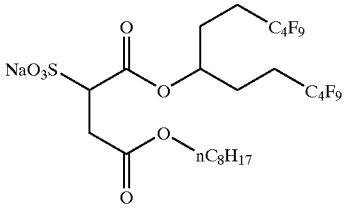

FS-334

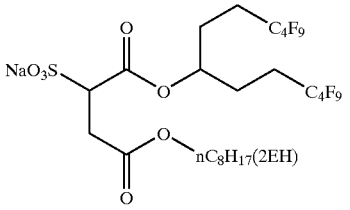

FS-335

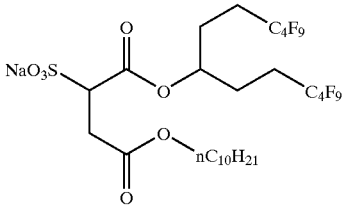

The compounds of the above general formula (B) can be easily synthesized by sequentially subjecting common maleic anhydride, etc. as a raw material to monoesterification reaction, acid halogenation, esterification reaction and sulfonation reaction. Further, the replacement of counter cation can be easily effected by the use of ion exchange resin.

Examples of representative synthetic methods will be described below; which however in no way limit the scope of the present invention.

SYNTHETIC EXAMPLE 2

Synthesis of Compound FS-303

2-1 Synthesis of 2-ethylhexyl maleate chloride 4.5 g (20 mmol) of mono(2-ethylhexyl)maleate, product of Aldrich, was slowly dropped in 4.1 g (20 mmol) of phosphorus pentachloride while maintaining the temperature of the mixture at 30° C. or below. After the completion of dropping, the mixture was agitated at room temperature for 1 hr. Thereafter, the mixture was heated to 60° C., and the pressure was reduced by an aspirator to thereby distill off formed phosphorus oxychloride. As a result, there was obtained 4.5 g (yield: 92%) of light brown oily compound consisting of 2-ethylhexyl maleate chloride.

2-2 Synthesis of mono(2-ethylhexyl) mono(2,2,3,3,4,4,4-heptafluorobutyl)maleate 66.8 g (0.334 mol) of 2,2,3,3,4,4,4-heptafluorobutanol and 29.6 mL (0.367 mol) of pyridine were dissolved in 180 mL of acetonitrile, and while maintaining the internal temperature at 20° C. or below by cooling with an ice bath, 90.6 g (0.367 mol) of mono(2-ethylhexyl) maleate chloride was dropped in the solution. After the completion of dropping, the mixture was agitated at room temperature for 1 hr. Thereafter, 1000 mL of ethyl acetate was added, and the organic phase was washed with a 1 mol/L aqueous hydrochloric acid solution and a saturated aqueous sodium chloride solution. The resultant organic layer was collected, and the organic solvent was distilled off in vacuum. Purification by silica gel column chromatography (hexane/chloroform: 10/0 to 7/3 v/v) was performed, thereby obtaining 80.3 g (yield: 59%) of desired compound as a colorless transparent oily compound.

2-3 Synthesis of sodium mono(2-ethylhexyl) mono(2,2,3,3,4,4,4-heptafluorobutyl)sulfosuccinate (FS-302)

80.3 g (0.196 mol) of mono(2-ethylhexyl)mono(2,2,3,3,4,4,4-heptafluorobutyl)maleate, 20.4 g (0.196 mol) of sodium hydrogen sulfite and 80 mL of water/ethanol (1/1 v/v) were mixed together and heated under reflux for 10 hr. Thereafter, 1000 mL of ethyl acetate was added, and the organic phase was washed with a saturated aqueous sodium chloride solution. The resultant organic layer was collected, and the organic solvent was distilled off in vacuum. Purification by silica gel column chromatography (chloroform/methanol: 9/1 v/v) was performed. The collected organic phase was washed with a saturated aqueous sodium chloride solution, and the organic solvent was distilled off in vacuum, thereby obtaining 32 g (yield: 32%) of desired compound as a colorless transparent solid.

$^1$H-NMR data of the obtained compound are as follows:

$^1$H-NMR (DMSO-d) δ 0.87 (m, 6H), 1.24 (m, 8H), 1.50 (br, 1H), 2.77–2.99 (m, 2H), 3.63–3.71 (m, 1H), 3.86–3.98 (m, 3H), 4.62–4.84 (br, 1H)

SYNTHETIC EXAMPLE 3

Synthesis of Compound FS-312

3-1 Synthesis of monodecyl mono(3,3,4,4,5,5,6,6,6-nonafluorohexyl)maleate 164.6 g (623 mmol) of 3,3,4,4,5,5,6,6,6-nonafluorohexanol and 49.3 mL (623 mol) of pyridine were dissolved in 280 mL of chloroform, and while maintaining the internal temperature at 20° C. or below by cooling with an ice bath, 155.8 g (566 mmol) of monodecyl maleate chloride was dropped in the solution. After the completion of dropping, the mixture was agitated at room temperature for 1 hr. Thereafter, ethyl acetate was added, and the organic phase was washed with a 1 mol/L aqueous hydrochloric acid solution and a saturated aqueous sodium chloride solution. The resultant organic layer was collected, and the organic solvent was distilled off in vacuum. Purification by silica gel column chromatography (hexane/chloroform: 10/0 to 7/3 v/v) was performed, thereby obtaining 48.2 g (yield: 18%) of desired compound.

3-2 Synthesis of sodium monodecyl mono(3,3,4,4,5,5,6,6,6-nonafluorohexyl) sulfosuccinate (FS-312)

48.0 g (90 mmol) of monodecyl mono(3,3,4,4,5,5,6,6,6-nonafluorohexyl) maleate, 10.4 g (99 mmol) of sodium hydrogen sulfite and 50 mL of water/ethanol (1/1 v/v) were mixed together and heated under reflux for 5 hr. Thereafter, ethyl acetate was added, and the organic phase was washed with a saturated aqueous sodium chloride solution. The resultant organic layer was collected, and the organic solvent was distilled off in vacuum. Recrystallization from acetonitrile was performed, thereby obtaining 12.5 g (yield: 22%) of desired compound as a colorless transparent solid.

$^1$H-NMR data of the obtained compound are as follows:

$^1$H-NMR (DMSO-d) δ 0.81–0.87 (t, 3H), 1.24 (m, 18H), 1.51 (br, 2H), 2.50–2.70 (m, 2H), 2.70–2.95 (m, 2H), 3.61–3.70 (m, 1H), 3.96 (m, 2H), 4.28 (ms, 2H)

SYNTHETIC EXAMPLE 4

Synthesis of Compound FS-309

4-1 Synthesis of mono(2-ethylhexyl) mono(3,3,4,4,5,5,6,6,6-nonafluorohexyl)maleate 515 g (1.95 mol) of 3,3,4,4,5,5,6,6,6-nonafluorohexanol, 169 g (2.13 mol) of pyridine and 394 mL (3.89 mol) of triethylamine were dissolved in 1000 mL of chloroform, and while maintaining the internal temperature at 20° C. or below by cooling with an ice bath, 530 g (2.14 mol) of 2-ethylhexyl maleate chloride was dropped in the solution. After the completion of dropping, the mixture was agitated at room temperature for 1 hr. Thereafter, chloroform was added, and the organic phase was washed with water and a saturated aqueous sodium chloride solution. The resultant organic layer was collected, and the organic solvent was distilled off in vacuum. Purification by silica gel column chromatography (hexane/chloroform: 10/0 to 7/3 v/v) was performed, thereby obtaining 508 g (yield: 50%) of colorless transparent desired compound.

4-2 Synthesis of sodium mono(2-ethylhexyl) mono(3,3,4,4,5,5,6,6,6-nonafluorohexyl) sulfosuccinate (FS-309)

137.5 g (0.29 mol) of mono(2-ethylhexyl) mono(3,3,4,4,5,5,6,6,6-nonafluorohexyl) maleate, 33.2 g (0.32 mol) of sodium hydrogen sulfite and 140 mL of water/ethanol (1/1 v/v) were mixed together and heated under reflux for 2 hr. Thereafter, 1000 mL of ethyl acetate was added, and the organic phase was washed with a saturated aqueous sodium chloride solution. The resultant organic layer was collected, and the organic solvent was distilled off in vacuum. Recrystallization from 800 mL of toluene was performed. Crystal was precipitated by cooling with an ice bath, and finally collected by filtration. As a result, there was obtained 140 g (yield; 84%) of colorless transparent desired compound.

$^1$H-NMR data of the obtained compound are as follows:

$^1$H-NMR (DMSO-$d_6$) δ 0.82–0.93 (m, 6H), 1.13–1.32 (m, 8H), 1.50 (br, 1H), 2.57–2.65 (m, 2H), 2.84–2,98 (m, 2H), 3.63–3.68 (m, 1H), 3.90 (d, 2H), 4.30 (m, 2H)

SYNTHETIC EXAMPLE 5

Synthesis of Compound FS-332

5-1 Synthesis of mono(2-ethylhexyl) mono(1,1,1,3,3,3-hexafluoro-2-propyl)maleate 33.7 g (201 mmol) of 1,1,1,3,3,3-hexafluoro-2-propanol (HFIP) and 17.9 mL (220 mmol) of pyridine were dissolved in 80 mL of acetonitrile, and while maintaining the internal temperature at 20° C. or below by cooling with an ice bath, 41.8 g (220 mmol) of mono(2-ethylhexyl) maleate chloride was dropped in the solution. After the completion of dropping, the mixture was agitated at room temperature for 1 hr. Thereafter, ethyl acetate was added, and the organic phase was washed with a 1 mol/L aqueous hydrochloric acid solution and a saturated aqueous sodium chloride solution. The resultant organic layer was collected, and the organic solvent was distilled off in vacuum. Purification by silica gel column chromatography (hexane/chloroform: 10/0 to 7/3 v/v) was performed, thereby obtaining 10.6 g (yield: 14%) of desired compound as a colorless transparent oily compound.

5-2 Synthesis of compound FS-332

10.6 g (28 mmol) of mono(2-ethylhexyl) mono(1,1,1,3,3,3-hexafluoro-2-propyl)maleate, 3.2 g (31 mmol) of sodium hydrogen sulfite and 10 mL of water/ethanol (1/1 v/v) were mixed together and heated under reflux for 10 hr. Thereafter, ethyl acetate was added, and the organic phase was washed with a saturated aqueous sodium chloride solution. The resultant organic layer was collected, and the organic solvent was distilled off in vacuum. Recrystallization from acetonitrile was performed, thereby obtaining 1.7 g (yield: 13%) of desired compound as a colorless transparent solid.

$^1$H-NMR data of the obtained compound are as follows:

$^1$H-NMR (DMSO-d) δ 0.81–0.87 (m, 6H), 1.25 (m, 8H), 1.50 (br, 1H), 2.73–2.85 (m, 2H), 3.59 (m, 1H), 3.85–3.90 (m, 2H), 12.23 (br, 1H)

Among the above various compounds, ionic surfactants can be used in the form of various salts produced by ion exchange, neutralization or other means, or in the presence of at least one counter ion, in accordance with the purpose of use thereof, needed properties, etc.

The fluorinated surfactants represented by the formulae (A) and (B) are preferably used in the coating compositions for forming layers (especially, protective layer, undercoat layer, back layer, etc.) that constitute a silver halide photographic lightsensitive material. Although, in particular, the use of such fluorinated surfactants in the formation of the hydrophilic colloid layer as the uppermost layer of a photographic lightsensitive material is especially preferred since effective antistatic capability and coating uniformity can be attained, the fluorinated surfactants may be incorporated in other layers or interlayers having a spectral sensitivity. The fluorinated surfactants may be incorporated in a plurality of layers or any one thereof. The fluorinated surfactants according to the present invention may be used each individually, or in the form of a fixture consisting of a plurality of different compounds. The use amount of fluorinated surfactants is preferably in the range of $10^{-6}$ to $10^{-1}$ mol/m$^2$. Moreover, other surfactants may be used in combination with the compounds of the present invention.

In the present invention, the terminology "spectral sensitivity distribution" refers to a function of photographic speed versus wavelength, the photographic speed at each wavelength referring to the inverse number of exposure intensity capable of realizing given density at each wavelength when spectral exposure with intervals of nanometers (nm) from 350 to 700 nm is applied to a silver halide color photographic lightsensitive material. In the present invention, the terminology "spectral sensitivity distribution of blue-sensitive layer" refers to a sensitivity distribution capable of realizing given yellow density.

In the silver halide color photographic lightsensitive material of the present invention, the spectral sensitivity ratio at 370 nm as compared to that at 420 nm, which imparts the same density as that of the sensitivity at 420 nm in the spectral sensitivity distribution of the blue sensitive layer, should be 70% or less, preferably 60% or less, more preferably 50% or less, and most preferably 30% or less.

In the present invention, it suffices only if the spectral sensitivity in the yellow density of any case satisfies the above-indicated relationship. However, it is preferable that the spectral sensitivity at any value within a density region of Dmin+0.3 to Dmin+1 should satisfy the above-indicated relationship.

Further, the developing process for obtaining the spectral sensitivity may be of any general methods for color negative development; however, the developing process described in Example 1 provided in the specification is recommended as a preferable method.

It is preferred that the silver halide emulsion for use in the lightsensitive material of the present invention be a silver iodobromide, silver bromide or silver chloroiodobromide tabular grain emulsion.

With respect to the color photographic lightsensitive material of the present invention, preferably, each unit lightsensitive layer is constituted of a plurality of silver halide emulsion layers which exhibit substantially identical color sensitivity but are different in speed, and 50% or more of the total projected area of silver halide grains contained in at least one layer of the emulsion layers with the highest photographic speed among the silver halide emulsion layers constituting each of the unit lightsensitive layers consists of tabular silver halide grains (hereinafter also referred to as "tabular grains"). In the present invention, the average aspect ratio of such tabular grains is preferably B or higher, more preferably 12 or higher, and most preferably 15 or higher.

With respect to tabular grains, the aspect ratio refers to the ratio of diameter to thickness of silver halides. That is, the aspect ratio is the quotient of diameter divided by thickness with respect to each individual silver halide grain. Herein, the diameter refers to the diameter of a circle with an area equal to the projected area of grain exhibited when silver halide grains are observed through a microscope or an electron microscope. Further, herein, the average aspect ratio refers to the average of aspect ratios regarding all the tabular grains of each emulsion.

The method of taking a transmission electron micrograph by the replica technique and measuring the equivalent circle diameter and thickness of each individual grain can be mentioned as an example of aspect ratio determining method. In the mentioned method, the thickness is calculated from the length of replica shadow.

The configuration of tabular grains of the present invention is generally hexagonal. The terminology "hexagonal configuration" means that the shape of the main planes of tabular grains is hexagonal, the adjacent side ratio (maximum side length/minimum side length) thereof being 2 or less. The adjacent side ratio is preferably 1.6 or less, more preferably 1.2 or less. It is needless to mention that the lower limit thereof is 1.0. In the grains of high aspect ratio, especially, triangular tabular grains are increased in the tabular grains. The triangular tabular grains are produced when the Ostwald ripening has excessively been advanced. From the viewpoint of obtaining substantially hexagonal tabular grains, it is preferred that the period of this ripening be minimized. For this purpose, it is requisite to endeavor to raise the tabular grain ratio by nucleation. It is preferred that one or both of an aqueous silver ion solution and an aqueous bromide ion solution contain gelatin for the purpose of raising the probability of occurrence of hexagonal tabular grains at the time of adding silver ions and bromide ions to a reaction mixture according to the double let technique, as described in JP-A-63-11928 by Saito.

The hexagonal tabular grains contained in the lightsensitive material of the present invention are formed through the steps of nucleation, Ostwald ripening and growth. Although all of these steps are important for suppressing the spread of grain size distribution, attention should be paid so as to avoid the spread of size distribution at the first nucleation step because the spread of size distribution brought about in the above steps cannot be narrowed by an ensuing step. What is important in the nucleation step is the relationship between the temperature of reaction mixture and the period of time of nucleation comprising adding silver ions and bromide ions to a reaction mixture according to the double jet technique and producing precipitates. JP-A-63-92942 by Saito describes that it is preferred that the temperature of the reaction mixture at the time of nucleation be in the range of from 20 to 45° C. for realizing a monodispersity enhancement. Further, JP-A-2-222940 by Zola et al describes that the suitable temperature at nucleation is 60° C. or below.

Supplemental addition of gelatin may be effected during the grain formation in order to obtain monodisperse tabular grains of high aspect ratio. The added gelatin is preferably a chemically modified gelatin as described in JP-A's-10-148897 and 11-143002. This chemically modified gelatin is a gelatin characterized in that at least two carboxyl groups have newly been introduced at a chemical modification of amino groups contained in the gelatin, and it is preferred that gelatin trimellitate be used as the same. Also, gelatin succinate is preferably used. The chemically modified gelatin is preferably added prior to the growth step, more preferably immediately after the nucleation. The addition amount thereof is preferably 60% or greater, more preferably 80% or greater, and most preferably 90% or greater, based on the total mass of dispersion medium used in grain formation.

The tabular grain emulsion is constituted of silver iodobromide or silver chloroiodobromide. Although silver chloride may be contained, the silver chloride content is preferably 8 molt or less, more preferably 3 molt or less, and most preferably 0 mol %. With respect to the silver iodide content, it is preferably 20 mol % or less inasmuch as the variation coefficient of the grain size distribution of the tabular grain emulsion is preferably 30% or less. The lowering of the variation coefficient of the distribution of equivalent circle diameter of the tabular grain emulsion can be facilitated by decreasing the silver iodide content. It is especially preferred that the variation coefficient of the grain size distribution of the tabular grain emulsion be 20% or less while the silver iodide content be 10 mol % or less.

Furthermore, it is preferred that the tabular grain emulsion have some intragranular structure with respect to the silver iodide distribution. The silver iodide distribution may have a double structure, a treble structure, a quadruple structure or a structure of higher order.

In the present invention, tabular grains have dislocation lines. Dislocation lines in tabular grains can be observed by a direct method performed using a transmission electron microscope at a low temperature, as described in, e.g., J. F. Hamilton, Phot. Sci. Eng., 11, 57, (1967) or T. Shiozawa, J. Soc. Phot. Sci. Japan, 3, 5, 213, (1972). That is, silver halide grains, carefully extracted front an emulsion so as not to apply any pressure by which dislocations are produced in the grains, are placed on a mesh for electron microscopic observation. Observation is performed by a transmission method while the sample is cooled to prevent damage (e.g., print out) due to electron rays. In this observation, as the thickness of a grain is increased, it becomes more difficult to transmit electron rays through it. Therefore, grains can be observed more clearly by using an electron microscope of a high voltage type (200 kV or more for a grain having a thickness of 0.25 $\mu$m). From photographs of grains obtained by the above method, it is possible to obtain the positions and the number of dislocations in each grain viewed in a direction perpendicular to the principal planes of the grain.

The average number of dislocation lines is preferably 10 or more, and more preferably, 20 or more per grain. If dislocation lines are densely present or cross each other, it is sometimes impossible to correctly count dislocation lines per grain. Even in these situations, however, dislocation lines can be roughly counted to such an extent that their number is approximately 10, 20, or 30. This makes it possible to distinguish these grains from those in which obviously only a few dislocation lines are present. The average number of dislocation lines per grain is obtained as a number average by counting dislocation lines of 100 or more grains. Several hundreds of dislocation lines are sometimes found.

Dislocation lines can be introduced to, e.g., a portion near the peripheral region of a tabular grain. In this case, dislocations are substantially perpendicular to the peripheral region and produced from a position x % of the length between the center and the edge (peripheral region) of a tabular grain to the peripheral region. The value of x is preferably 10 to less than 100, more preferably, 30 to less than 99, and most preferably, 50 to less than 98. Although the shape obtained by connecting the start positions of the dislocations is almost similar to the shape of the grain, this shape is not perfectly similar but sometimes distorted. Dislocations of this type are not found in the central region of a grain. The direction of dislocation lines is crystallographically, approximately a (211) direction. Dislocation lines, however, are often zigzagged and sometimes cross each other.

A tabular grain can have dislocation lines either almost uniformly across the whole peripheral region or at a particular position of the peripheral region. That is, in the case of a hexagonal tabular silver halide grain, dislocation lines can be limited to either portions near the six corners or only a portion near one of the six corners. In contrast, it is also possible to limit dislocation lines to only portions near the edges except for the portions near the six corners.

Dislocation lines can also be formed across a region containing the centers of two principal planes of a tabular grain. When dislocation lines are formed across the entire region of the principal planes, the direction of the dislocation lines is sometimes crystallographically, approximately a (211) direction with respect to a direction perpendicular to the principal planes. In some cases, however, the direction is a 110) direction or random. The lengths of the individual dislocation lines are also random; the dislocation lines are sometimes observed as short lines on the principal planes and sometimes observed as long lines reaching the edges (peripheral region). Although dislocation lines are sometimes straight, they are often zigzagged. In many cases, dislocation lines cross each other.

As described above, the position of dislocation lines can be either limited on the peripheral region or the principal planes or a local position on at least one of them. That is, dislocation lines can be present on both the peripheral region and the principal planes.

Introducing dislocation lines to a tabular grain can be achieved by forming a specific silver iodide rich phase inside the grain. This silver iodide rich phase can include a discontinuous silver iodide rich region. More specifically, after a substrate grain is prepared, the silver iodide rich phase is formed and covered with a layer having a silver iodide content lower than that of the silver iodide rich phase. The silver iodide content of the substrate tabular grain is lower than that of the silver iodide rich phase, and is preferably 0 to 20 mol %, and more preferably, 0 to 15 mol %.

In this specification, the silver iodide rich phase inside a grain is a silver halide solid solution containing silver iodide. This silver halide is preferably silver iodide, silver iodobromide, or silver bromochloroiodide, and more preferably, silver iodide or silver iodobromide (the silver iodide content with respect to a silver halide contained in this silver iodide rich phase is 10 to 40 mol %). To cause this silver iodide rich phase inside a grain (to be referred to as an internal silver iodide rich phase hereinafter) to selectively exist on the edge, the corner, or the surface of a substrate grain, it is desirable to control the formation conditions of the substrate grain, the formation conditions of the internal silver iodide rich phase, and the formation conditions of a phase covering the outside of the internal silver iodide rich phase. Important factors as the formation conditions of a substrate grain are the pAg (the logarithm of the reciprocal of a silver ion concentration), the presence/absence, type, and amount of a silver halide solvent, and the temperature. By controlling the pAg to preferably 8.5 or less, more preferably, 8 or less during the growth of substrate grains, the internal silver iodide rich phase can be made to selectively exist in portions near the corners or on the surface of the substrate grain, when this silver iodide rich phase is formed later.

On the other hand, by controlling the pAg to preferably 8.5 or more, more preferably, 9 or more during the growth of substrate grains, the internal silver iodide rich phase can be made to exist on the edges of the substrate grain. The threshold value of the pAg rises- and falls depending on the temperature and the presence/absence, type, and amount of a silver halide solvent. When thiocyanate is used as the silver halide solvent, this threshold value of the pAg shifts to higher values. The value of the pAg at the end of the growth of substrate grains is particularly important, among other pAg values during the growth. On the other hand, even if the pAg during the growth does not meet the above value, the position of the internal silver iodide rich phase can be controlled by performing ripening by controlling the pAg to the above proper value after the growth of substrate grains. In this case, ammonia, an amine compound, a thiourea derivative, or thiocyanate salt can be effectively used as the silver halide solvent. The internal silver iodide rich phase can be formed by a so-called conversion method.

This method includes a method which, at a certain point during grain formation, adds halogen ion smaller in solubility for salt for forming silver ion than halogen ion that forms grains or portions near the surfaces of grains at that point. In the present invention, the amount of halogen ion having a smaller solubility to be added preferably takes a certain value (related to a halogen composition) with respect to the surface area of grains at that point. For example, at a given point during grain formation, it is preferable to add a certain amount or more of KI with respect to the surface area of silver halide grains at that point. More specifically, it is preferable to add $8.2\times10^{-5}$ mol/$m^2$ or more of iodide salt.

A more preferable method of forming the internal silver iodide rich phase is to add an aqueous silver salt solution simultaneously with addition of an aqueous silver halide solution containing iodide salt.

As an example, an aqueous $AgNO_3$ solution is added simultaneously with addition of an aqueous KI solution by the double-jet method. In this case, the addition start timings and the addition end timings of the aqueous KI solution and the aqueous $AgNO_3$ solution can be shifted from each other. The addition molar ratio of the aqueous $AgNO_3$ solution to the aqueous KI solution is preferably 0.1 or more, more preferably, 0.5 or more, and most preferably, 1 or more. The total addition molar quantity of the aqueous $AgNO_3$ solution can exit in a silver excess region with respect to halogen ion in the system and iodine ion added. During the addition of the aqueous silver halide solution containing iodine ion and the addition of the aqueous silver salt solution by the double-jet method, the pAg preferably decreases with the addition time by the double-jet. The pAg before the addition is preferably 6.5 to 13, and more preferably, 7.0 to 11. The pAg at the end of the addition is most preferably 6.5 to 10.0.

In carrying out the above method, the solubility of a silver halide in the mixing system is preferably as low as possible. Therefore, the temperature of the mixing system at which the silver iodide rich phase is formed is preferably 30° C. to 80° C., and more preferably, 30° C. to 70° C.

The formation of the internal silver iodide rich phase is most preferably performed by adding fine-grain silver iodide, fine-grain silver iodobromide, fine-grain silver chloroiodide, or fine-grain silver bromochloroiodide. The addition of fine-grain silver iodide is particularly preferred. These fine grains normally have a grain size of 0.01 to 0.1 μm, but those having a grain size of 0.01 μm or less or 0.1 μm or more can also be used. Methods of preparing these fine silver halide grains are described in JP-A's-1-183417, 2-44335, 1-183644, 1-183645, 2-43534, and 2-43535, the disclosures of which are incorporated herein by reference. The internal silver iodide rich phase can be formed by adding and ripening these fine silver halide grains. In dissolving the fine grains by ripening, the silver halide solvent described above can also be used. These fine grains added need not immediately, completely dissolve to disappear but need only disappear by dissolution when the final grains are completed.

The internal silver iodide rich phase is located in a region of, when measuring from the center of, e.g., a hexagon formed in a plane by projecting a grain thereon, preferably 5 to less than 100 mol %, more preferably, 20 to less than 95 mol %, and most preferably, 50 to less than 90 mol % with respect to the total silver amount of the grain. The amount of a silver halide which forms the internal silver iodide rich phase is, as a silver amount, preferably 50 molt or less, and more preferably, 20 mol or less of the total silver amount of a grain. These values of amounts of the silver iodide rich phase are not those obtained by measuring the halogen composition of the final grain by using various analytical methods but formulated values in the producing of a silver halide emulsion. The internal silver iodide rich phase often disappears from the final grain owing to, e.g., recrystallization, and so all silver amounts described above are related to their formulated values.

It is, therefore, readily possible to observe dislocation lines in the final grains by the above method, but the internal silver iodide rich phase introduced to introduce dislocation lines cannot be observed as a definite phase in many cases because the silver iodide composition in the boundary continuously changes. The halogen compositions in each portion of a grain can be checked by combining X-ray diffraction, an EPMA (also called an XMA) method (a method of scanning a silver halide grain by electron rays to detect its silver halide composition), and an ESCA (also called an XPS) method (a method of radiating X-rays to spectroscopically detect photoelectrons emitted front the surface of a grain).

The silver iodide content of an outer phase covering the internal silver iodide rich phase is lower than that of the silver iodide rich phase, and is preferably 0 to 30 mol %, more preferably, 0 to 20 mol %, and most preferably, 0 to 10 mol % with respect to a is silver halide amount contained in the outer phase.

Although the temperature and the pAg, at which the outer phase covering the internal silver iodide rich phase is formed, can take arbitrary values, the temperature is preferably 30° C. to 80° C., and most preferably, 35° C. to 70° C., and the pAg is preferably 6.5 to 11.5. The use of the silver halide solvents described above is sometimes preferable, and the most preferable silver halide solvent is thiocyanate salt.

Another method of introducing dislocation lines to tabular grains is to use an iodide ion releasing agent as described in JP-A-6-11782, the disclosure of which is incorporated herein by reference. This method is also preferably used.

Dislocation lines can also be introduced by appropriately combining this dislocation line introducing method with the above-mentioned dislocation line introducing method.

The variation coefficient of the inter-grain iodide distribution of silver halide grains contained in a light-sensitive material of the present invention is preferably 20% or less, more preferably, 15% or less, and most preferably, 10% or less. If the variation coefficient of the iodide content distribution of each individual silver halide is larger than 20%, no high contrast can be obtained, and a reduction of the sensitivity upon application of a pressure increases.

Any known method can be used as a method of producing silver halide grains contained in a light-sensitive material of the present invention and having a narrow inter-grain iodide distribution. Examples are a method of adding fine grains as disclosed in JP-A-1-183417 and a method which uses an iodide ion releasing agent as disclosed in JP-A-2-68538, the disclosures of which are incorporated herein by reference. These methods can be used alone or in combination.

The variation coefficient of the inter-grain iodide distribution of silver halide grains of the present invention is preferably 20% or less. The most preferred method of monodispersing the inter-grain iodide distribution is a method described in JP-A-3-213845, the disclosure of which is incorporated herein by reference. That is, fine silver halide grains containing 95 mol % or more of silver iodide are formed by mixing an aqueous solution of a water-soluble silver salt and an aqueous solution of a water-soluble halide (containing 95 mol % or more of iodide ions) in a mixer placed outside a reaction vessel, and supplied to the reaction vessel immediately after the formation. In this manner, a monodisperse inter-grain iodide distribution can be achieved. The reaction vessel is a vessel which causes nucleation and/or crystal growth of tabular silver halide grains.

As described in JP-A-3-213845, the disclosure of which is incorporated herein by reference, the following three technologies can be used as a method of adding the silver halide grains prepared in the mixer and as a preparing means used in the method.

(1) After being formed in the mixer, the fine grains are immediately added to the reaction vessel.

(2) Strong and efficient stirring is performed in the mixer.

(3) An aqueous protective colloid solution is poured into the mixer.

The protective colloid used in method (3) above can be singly poured into the mixer or can be poured into the mixer after being contained in an aqueous halogen salt solution or aqueous silver nitrate solution. The concentration of the protective colloid is 1 mass % or more, preferably 2 to 5 mass %. Examples of a polymer compound having a protective colloid function with respect to silver halide grains used in the present invention are a polyacrylamide polymer, an amino polymer, a polymer having a thioether group, polyvinyl alcohol, an acrylic acid polymer, a polymer having hydroxyquinoline, cellulose, starch, acetal, polyvinylpyrrolidone, and a ternary polymer. The use of low-molecular-weight gelatin is preferred. The weight-average molecular weight of this low-molecular-weight gelatin is preferably 30,000 or less, and more preferably, 10,000 or less.

When fine silver halide grains are to be prepared, the grain formation temperature is preferably 35° C. or less, and particularly preferably, 25° C. or less. The temperature of the reaction vessel to which fine silver halide grains are added is sot or more, preferably 60° C. or more, and more preferably, 70° C. or more.

The grain size of a fine silver halide used in the present invention can be directly confirmed by a transmission electron microscope by placing the grain on a mesh. The size of fine grains of the present invention is preferably 0.3 μm or less, more preferably, 0.1 μm or less, and most preferably, 0.01 μm or less. This fine silver halide can be added simultaneously with another halogen ion or silver ion or can be added alone. The mixing amount of the fine silver halide grains is 0.005 to 20 mol %, preferably 0.01 to 10 mol % with respect to a total silver halide.

The silver iodide content of each grain can be measured by analyzing the composition of the grain by using an X-ray microanalyzer. The variation coefficient of an inter-grain iodide distribution is a value defined by $$(\text{standard deviation/average silver iodide content}) \times 100 = \text{variation coefficient } (\%)$$

by using the standard deviation of silver iodide contents and the average silver iodide content when the silver iodide contents of at least 100, more preferably, 200, and most preferably, 300 emulsion grains are measured. The measurement of the silver iodide content of each individual grain is described in, e.g., European Patent 147,868. A silver iodide content Yi [mol %] and an equivalent-sphere diameter Xi [μm] of each grain sometimes have a correlation and sometimes do not. However, Yi and Xi desirably have no correlation. The halogen composition structure of a tabular grain of the present invention can be checked by combining, e.g., X-ray diffraction, an EPMA (also called an XMA) method (a method of scanning a silver halide grain by electron rays to detect its silver halide composition), and an ESCA (also called an XPS) method (a method of radiating X-rays to spectroscopically detect photoelectrons emitted from the surface of a grain). When the silver iodide content is measured in the present invention, the grain surface is a region about 5 nm deep from the surface, and the grain interior is a region except for the surface. The halogen composition of this grain surface can usually be measured by the ESCA method.

In the present invention, regular-crystal grains such as cubic, octahedral, and tetradecahedral grains and irregular twinned-crystal grains can be used in addition to aforementioned tabular grains.

Silver halide emulsions of the present invention are preferably subjected to selenium sensitization or gold sensitization.

As selenium sensitizers usable in the present invention, selenium compounds disclosed in conventionally known patents can be used. Usually, a labile selenium compound and/or a non-labile selenium compound is used by adding it to an emulsion and stirring the emulsion at a high temperature, preferably 40° C. or more for a predetermined period of time. As non-labile selenium compounds, it is preferable to use compounds described in, e.g., Jpn. Pat. Appln. KOKOKU Publication No. (hereinafter referred to as JP-B-) 44-15748, JP-B-43-13489, and JP-A's-4-25832 and 4-109240, the disclosures of which are incorporated herein by reference.

Practical examples of a labile selenium sensitizer are isoselenocyanates (e.g., aliphatic isoselenocyanates such as allylisoselenocyanate), selenoureas, selenoketones, selenoamides, selenocarboxylic acids (e.g., 2-selenopropionic acid and 2-selenobutyric acid), selenoesters, diacylselenides (e.g., bis (3-chloro-2,6-dilethoxybenzoyl)selenide), selenophosphates, phosphineselenides, and colloidal metal selenium.

Although preferred examples of a labile selenium compound are described above, the present invention is not limited to these examples. It is generally agreed by those skilled in the art that the structure of a labile selenium compound used as a sensitizer for a photographic emulsion is not so important as long as selenium is labile, and that the organic part of a molecule of a selenium sensitizer has no important role except the role of carrying selenium and keeping it in a labile state in an emulsion. In the present invention, therefore, labile selenium compounds in this extensive concept are advantageously used.

Examples of a non-labile selenium compound usable in the present invention are compounds described in JP-B's-46-4553, 52-34491, and 52-34492, the disclosures of which are incorporated herein by reference.

Practical examples of a non-labile selenium compound are selenious acid, potassium selenocyanide, selenazoles, quaternary ammonium salts of selenazoles, diarylselenide, diaryldiselenide, dialkylselenide, dialkyldiselenide, 2-selenazolidinedione, 2-selenoxazolidinethione, and derivatives of these compounds.

These selenium sensitizers are dissolved in water, an organic solvent such as methanol or ethanol, or a solvent mixture of such organic solvents, and the resultant solution is added during chemical sensitization, preferably before the start of chemical sensitization. A selenium sensitizer to be used is not limited to one type, but two or more types of the selenium sensitizers described above can be used together. Combining a labile selenium compound and a non-labile selenium compound is preferred.

The addition amount of selenium sensitizers usable in the present invention changes in accordance with the activity of each selenium sensitizer used, the type or grain size of a silver halide, and the temperature and time of ripening. The addition amount, however, is preferably $2\times10^{-6}$ to $5\times10^{-6}$ mol per mol of a silver halide. When selenium sensitizers are used, the temperature or chemical sensitization is preferably 40° C. to 80° C. The pAg and pH can take given values. For example, the effect of the present invention can be obtained in a wide pH range of 4 to 9.

Selenium sensitization can be achieved more effectively in the presence of a silver halide solvent.

Examples of a silver halide solvent usable in the present invention are (a) organic thioethers described in U.S. Pat. Nos. 3,271,157, 3,531,289, and 3,574,628, and JP-A's-54-1019 and 54-158917, the disclosures of which are incorporated herein by reference, (b) thiourea derivatives described in JP-A's-53-82408, 55-77737, and 55-2982, the disclosures of which are incorporated herein by reference, (c) a silver halide solvent having a thiocarbonyl group sandwiched between an oxygen or sulfur atom and a nitrogen atom, described in JP-A-53-144319, the disclosure of which is incorporated herein by reference, (d) imidazoles described in JP-A-54-100717, the disclosure of which is incorporated herein by reference, (e) sulfite, and (f) thiocyanate.

Most preferred examples of a silver halide solvent are thiocyanate and tetramethylthiourea. Although the amount of a solvent to be used changes in accordance with its type, a preferred amount is $1\times10^{-4}$ to $1\times10^{-2}$ mmol per mol of a silver halide.

A gold sensitizer for use in gold sensitization of the present invention can be any compound having an oxidation number of gold of +1 or +3, and it is possible to use gold compounds normally used as gold sensitizers. Representative examples are chloroaurate, potassium chloroaurate, auricrichloride, potassium auricthiocyanate, potassium iodoaurate, tetracyanoauric aced, ammonium aurothiocyanate, pyridyltrichloro gold, gold sulfide, and gold selenide. Although the addition amount of gold sensitizers changes in accordance with various conditions, the amount is preferably $1\times10^{-7}$ to $5\times10^{-5}$ mol per mol of a silver halide.

Emulsions of the present invention are preferably subjected to sulfur sensitization during chemical sensitization.

This sulfur sensitization is commonly performed by adding sulfur sensitizers and stirring the emulsion for a predetermined time at a high temperature, preferably 40° C. or more.

Sulfur sensitizers known to those skilled in the art can be used in sulfur sensitization. Examples are thiosulfate, allylthiocarbamidothiourea, allylisothiacyanate, cystine, p-toluenethiosulfonate, and rhodanine. It is also possible to use sulfur sensitizers described in, e.g., U.S. Pat. Nos. 1,574,944, 2,410,689, 2,278,947, 2,728,668, 3,501,313, and 3,656,955, German Patent 1,422,869, JP-B-56-24937, and JP-A-55-45016, the disclosures of which are incorporated herein by reference. The addition amount of sulfur sensitizers need only be large enough to effectively increase the sensitivity of an emulsion. This amount changes over a wide range in accordance with various conditions, such as the pH, the temperature, and the size of silver halide grains. However, the amount is preferably $1\times10^{-7}$ to $5\times10^{-5}$ mol per mol of a silver halide.

Silver halide emulsions of the present invention can also be subjected to reduction sensitization during grain formation, after grain formation and before or during chemical sensitization, or after chemical sensitization.

Reduction sensitization can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. Two or more of these methods can also be used together.

The method of adding reduction sensitizers is preferred in that the level of reduction sensitization can be finely adjusted.

Known examples of reduction sensitizers are stannous salt, ascorbic acid and its derivative, amines and polyamines, a hydrazine derivative, formamidinesulfinic acid, a silane compound, and a borane compound. In reduction sensitization of the present invention, it is possible to selectively use these known reduction sensitizers or to use two or more types of compounds together. Preferred compounds-as reduction sensitizers are stannous chloride, thiourea dioxide, dimethylamineborane, and ascorbic acid and its derivative. Although the addition amount of reduction sensitizers must be so selected as to meet the emulsion producing conditions, a preferable amount is $10^{-7}$ to $10^{-3}$ mol per mol of a silver halide.

Reduction sensitizers are dissolved in water or an organic solvent such as alcohols, glycols, ketones, esters, or amides, and the resultant solution is added during grain growth. Although adding to a reactor vessel in advance is also preferred, adding at a given timing during grain growth is more preferred. It is also possible to add reduction sensitizers to an aqueous solution of a water-soluble silver salt or of a water-soluble alkali halide to precipitate silver halide grains by using this aqueous solution. Alternatively, a solution of reduction sensitizers can be added separately several times or continuously over a long time period with grain growth.

It is preferable to use an oxidizer for silver during the process of producing emulsions of the present invention. An oxidizer for silver is a compound having an effect of converting metal silver into silver ion. A particularly effective compound is the one that converts very fine silver grains, formed as a by-product in the process of formation and chemical sensitization of silver halide grains, into silver ion. The silver ion produced can form a silver salt hard to dissolve in water, such as a silver halide, silver sulfide, or silver selenide, or a silver salt easy to dissolve in water, such as silver nitrate. An oxidizer for silver can be either an inorganic or organic substance. Examples of an inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4]\ 3H_2O$, $4K_2SO_4.Ti(O_2)OH.SO_4.2H_2O$, and $Na_3[VO(O_2)(C_2H_4)_2.6H_2O]$), permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of an organic oxidizer are quinones such as p-quinone, an organic peroxide such as peracetic acid and perbenzoic acid, and a compound for releasing active halogen (e.g., N-brontosuccinimide, chloramine T, and chloramine B).

Preferable oxidizers of the present invention are inorganic oxidizers such as ozone, hydrogen peroxide and its adduct, a halogen element, and thiosulfonate, and organic oxidizers such as quinones.

It is preferable to use the reduction sensitization described above and the oxidizer for silver together. In this case, the reduction sensitization can be performed after the oxidizer is used or vice versa, or the oxidizer can be used simultaneously with the reduction sensitization. These methods can be applied to both the grain formation step and the chemical sensitization step.

Photographic emulsions of the present invention can achieve high color saturation when spectrally sensitized by preferably methine dyes and the like. Usable dyes involve a cyanine dye, merocyanine dye, composite cyanine dye, composite merocyanine dye, holopolar cyanine dye, hemicyanine dye, styryl dye, and hemioxonole dye. Most useful dyes are those belonging to a cyanine dye, merocyanine dye, and composite merocyanine dye. These dyes can contain any nucleus commonly used as a basic heterocyclic nucleus in cyanine dyes.

Examples are a pyrroline nucleus, oxazoline nucleus, thiazoline nucleus, pyrrole nucleus, oxazole nucleus, thiazole nucleus, selenazole nucleus, imidazole nucleus, tetrazole nucleus, and pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, benzindolenine nucleus, indole nucleus, benzoxadole nucleus, naphthoxazole nucleus, benzthiazole nucleus, naphthothiazole nucleus, benzoselenazole nucleus, benzimidazole nucleus, and quinoline nucleus. These nuclei can be substituted on a carbon atom.

It is possible to apply to a merocyanine dye or a composite merocyanine dye a 5- or 6-membered heterocyclic nucleus as a nucleus having a ketomethylene structure. Examples are a pyrazoline-5-one nucleus, thiohydantoin nucleus, 2-thiooxazolidine-2,4-dione nucleus, thiazolidine-2,4-dione nucleus, rhodanine nucleus, and thiobarbituric acid nucleus.

Although these sensitizing dyes can be used singly, they can also be combined. The combination of sensitizing dyes is often used for a supersensitization purpose. Representative examples of the combination are described in U.S. Pat. Nos. 2,688,545, 2,977,229, 3,397,060, 3,522,0523, 3,527,641, 3,617,293, 3,628,964, 3,666,480, 3,672,898, 3,679,4283, 3,703,377, 3,769,301, 3,814,609, 3,837,862, and 4,026,707, British Patents 1,344,281 and 1,507,803, JP-B's-43-4936 and 53-12375, and JP-A's-52-110618 and 52-109925, the disclosures of which are incorporated herein by reference.

In addition to sensitizing dyes, emulsions can contain dyes having no spectral sensitizing effect or substances not substantially absorbing visible light and presenting supersensitization.

Further, the present invention is preferably combined with a technique of increasing a light absorption factor by the addition of a spectral sensitizing dye. For example, there can be mentioned more than monolayer saturated adsorption (namely, single-layer adsorption) of a sensitizing dye onto the surface of silver halide grains by means of intermolecular force, or adsorption of a so-called connected dye, comprising a plurality of chromophores connected to each other by covalent bonds without separate conjugation. In particular, it is more preferred to combine the present invention with techniques described in the following patent publications:

JP-A's-10-239789, 11-133531, 2000-267216, 2000-275772, 2001-75222, 2001-75247, 2001-75221, 2001-75226, 2001-75223, 2001-255615, 2002-23294, 10-171058, 10-186559, 10-197980, 2000-81678, 2001-5132, 2001-166413, 2002-49113, 64-91134, 10-110107, 10-171058, 10-226758, 10-307358, 10-307359, 10-310715, 2000-231174, 2000-231172, 2000-231173 and 2001-356442 and EP's 985965A, 985964A, 985966A, 985967A, 1085372A, 1085373A, 1172688A, 1199595A and 887700A1.

It is still more preferred to combine the present invention with techniques described in the following patent publications:

JP-A's-10-239789, 2001-75222 and 10-171058.

Sensitizing dyes can be added to an emulsion at any point conventionally known to be useful during the preparation of an emulsion. Most ordinarily, sensitizing dyes are added after the completion of chemical sensitization and before coating. However, it is possible to perform the addition simultaneously with the addition of chemical sensitizing dyes to thereby perform spectral sensitization and chemical sensitization at the same time, as described in U.S. Pat. Nos. 3,628,969 and 4,225,666, the disclosures of which are incorporated herein by reference. It is also possible to perform the addition prior to chemical sensitization, as described in JP-A-58-113928, the disclosure of which is incorporated herein by reference, or before the completion of the formation of a silver halide grain precipitate to thereby start spectral sensitization. Alternatively, as disclosed in U.S. Pat. No. 4,225,666, these sensitizing dyes can be added separately; a portion of the sensitizing dyes is added prior to chemical sensitization, and the rest is added after that. That is, sensitizing dyes can be added at any timing during the formation of silver halide grains, including the method disclosed in U.S. Pat. No. 4,183,756, the disclosure of which is incorporated herein by reference.

When a plurality of sensitizing dyes are to be added, these sensitizing dyes can be separately added with predetermined pauses between them or added mixedly, or a portion of one sensitizing dye is previously added and the rest is added together with the other sensitizing dyes. That is, it is possible to select an optimuim method in accordance with the types of the chosen sensitizing dyes and with the desired spectral sensitivity.

The addition amount of sensitizing dyes can be $4\times10^{-6}$ to $8\times10^{-3}$ mol per mol of a silver halide. However, for a more favorable silver halide grain size of 0.2 to 1.2 $\mu$m, an addition amount of about $5\times10^{-5}$ to $2\times10^{-3}$ mol is more effective.

The twin plane spacing of a silver halide grain of the present invention is preferably 0.017 $\mu$m or less, more preferably, 0.007 to 0.017 $\mu$m, and most preferably, 0.007 to 0.015 $\mu$m.

Fog occurring while a silver halide emulsion of the present invention is aged can be improved by adding and dissolving a previously prepared silver iodobromide emulsion during chemical sensitization. This silver iodobromide emulsion can be added at any timing during chemical sensitization. However, it is preferable to first add and dissolve the silver iodobromide emulsion and then add sensitizing dyes and chemical sensitizers in this order. The silver iodobromide emulsion used has an iodide content lower than the surface iodide content of a host grain, and is preferably a pure-silver bromide emulsion. The size of this silver iodobromide emulsion is not limited as long as the emulsion can be completely dissolved. However, the equivalent-sphere diameter is preferably 0.1 $\mu$m or less, and more preferably, 0.05 $\mu$m or less. Although the addition amount of the silver iodobromide emulsion changes in accordance with a host grain used, the amount is basically preferably 0.005 to 5 molt, and more preferably, 0.1 to 1 mol % per mol of silver.

Common dopants known to be useful to silver halide emulsions can be used in emulsions used in the present invention. Examples of common dopants are Fe, Co, Ni, Ru, Rh, Pd, Re, Os, Ir, Pt, Au, Hg, Pb, and Tl. In the present invention, a hexacyano iron(II) complex and hexacyanoruthenium complex (to be simply referred to as "metal complexes" hereinafter) are preferably used.

The addition amount of these metal complexes is preferably $10^{-7}$ to $10^{-3}$ mol, and more preferably, $1.0\times10^{-5}$ to $5\times10^{-4}$ mol per mol of a silver halide.

Metal complexes used in the present invention can be added in any stage of the preparation of silver halide grains, i.e., before or after nucleation, growth, physical ripening, or chemical sensitization. Also, metal complexes can be divisionally added a plurality of times. However, 50% or more of the total content of metal complexes contained in a silver halide grain are preferably contained in a layer ½ or less as a silver amount from the outermost surface of the grain. A layer not containing metal complexes can also be formed on the outside, i.e., on the side away from a support, of the layer containing metal complexes herein mentioned.

These metal complexes are preferably contained by dissolving them in water or an appropriate solvent and directly adding the solution to a reaction solution during the formation of silver halide grains, or by forming silver halide grains by adding them to an aqueous silver salt solution, aqueous silver salt solution, or some other solution for forming the grains. Alternatively, these metal complexes are also favorably contained by adding and dissolving fine silver halide grains previously made to contain the metal complexes, and depositing these grains on other silver halide grains.

When these metal complexes are to be added, the hydrogen ion concentration in a reaction solution is such that the pH is preferably 1 to 10, and more preferably, 3 to 7.

The silver halide color photographic lightsensitive material of the present invention preferably comprises, on a support, a red-sensitive layer unit including at least two red-sensitive silver halide emulsion layers, a green-sensitive layer unit including at least two green-sensitive silver halide emulsion layers, and a blue-sensitive layer unit including at least two blue-sensitive silver halide emulsion layers, wherein no DIR compound which releases a development inhibitor and/or its precursor Is substantially contained in a most high-speed sensitive layer of said at least one color sensitive layer unit.

In a multilayered silver halide color photographic light-sensitive material, unit light-sensitive layers are generally arranged in the order of red-, green-, and blue-sensitive layers from a support. However, according to the intended use, this order of arrangement can be reversed, or light-sensitive layers sensitive to the same color can sandwich another light-sensitive layer sensitive to a different color. Non-light-sensitive layers can be formed between the silver halide sensitive layers and as the uppermost layer and the lowermost layer. These non-light-sensitive layers can contain, e.g., couplers, DIR compounds, and color amalgamation inhibitors to be described later. As a plurality of silver halide emulsion layers constituting each unit light-sensitive layer, as described in DE1,121,470 or GB923,045, the disclosures of which are incorporated herein by reference, high- and low-speed emulsion layers are preferably arranged such that the sensitivity is sequentially decreased toward a support. Also, as described in JP-A's-57-112751, 62-200350, 62-206541, and 62-206543, the disclosures of which are incorporated herein by reference, layers can be arranged such that a low-speed emulsion layer is formed apart from a support and a high-speed emulsion layer is formed close to the support.

More specifically, layers can be arranged, from the one farthest front a support, in the order of a low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL, or the order of BH/BL/GH/GL/RL/RH.

In addition, as described in JP-5-5-34932, the disclosure of which is incorporated herein by reference, layers can be arranged in the order of a blue-sensitive layer/GH/RH/GL/RL from the one farthest front a support. Furthermore, as described in JP-A's-56-25738 and 62-63936, the disclosures of which are incorporated herein by reference, layers can be arranged in the order of a blue-sensitive layer/GL/RL/GH/RH from the one farthest from a support.

As described in JP-B-49-15495, the disclosure of which is incorporated herein by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities can be arranged such that the sensitivity is sequentially decreased toward a support. Even when a layer structure is thus constituted by three layers having different sensitivities, these layers can be arranged, in a layer sensitive to one color, in the order of a medium-speed emulsion layer/high-speed emulsion layer/low-speed emulsion layer from the one farthest from a support as described in JP-A-59-202464, the disclosure of which is incorporated herein by reference.

In addition, the order of a high-speed emulsion layer/low-speed emulsion layer/medium-speed emulsion layer or low-speed emulsion layer/medium-speed emulsion layer/high-speed emulsion layer can be used.

Furthermore, the arrangement can be changed as described above even when four or more layers are formed.

As a means for improving the color reproduction, the use of an interlayer inhibiting effect is preferred.

It is further preferable to form a donor layer which donates the interlayer effect to a red-sensitive layer. It is particularly preferable that a weight-average sensitivity wavelength $\lambda_G$, represented by the following equation (III), of the spectral sensitivity distribution of a green-sensitive silver halide emulsion layer be 520 nm$<\lambda_G\leqq$580 nm, that the weight-average wavelength ($\lambda_{-R}$) of the spectral sensitivity distribution of the interlayer effect, which a red-sensitive silver halide emulsion layer is given from other silver halide emulsion layers within the range of 500 to 600 nm, be 500 nm$<\lambda_{-R}\leqq$560 nm, and that $\lambda_G-\lambda_{-R}$ be preferably 5 nm or more, more preferably 10 nm or more.

$$\lambda_G = \frac{\int_{500}^{600} \lambda S_G(\lambda) d\lambda}{\int_{500}^{600} S_G(\lambda) d\lambda}$$

where $S_G(\lambda)$ is the spectral sensitivity distribution curve of the green-sensitive silver halide emulsion layer, and $S_G$ at a specific wavelength $\lambda$ is represented by the reciprocal of an exposure amount by which a cyan density is fog +0.5 when exposed to the specific wavelength.

To obtain the interlayer effect to a red-sensitive layer as described above in a specific wavelength region, it is preferable to separately form an interlayer effect donor layer containing silver halide grains spectrally sensitized to a predetermined degree.

To implement the spectral sensitivity of the present invention, the weight-average sensitivity wavelength of this interlayer effect donor layer is set between 510 and 540 nm.

The weight-average wavelength $\lambda_{-R}$ of the wavelength distribution of the magnitude of the interlayer effect, which a red-sensitive silver halide emulsion layer is given from other silver halide emulsion layers, can be calculated by a method described in JP-B-3-10287, the disclosure of which is incorporated herein by reference.

In the present invention, it is preferred that the weight-average wavelength of red-sensitive layer $\lambda_R$ be 630 nm or less. Herein, the weight-average wavelength of red-sensitive layer $\lambda_R$ is defined by the following formula (I).

$$\lambda_R = \frac{\int_{550}^{700} \lambda S_R(\lambda) d\lambda}{\int_{550}^{700} S_R(\lambda) d\lambda} \quad \text{(I)}$$

In the formula, $S_R(\lambda)$ refers to the spectral sensitivity distribution curve of red-sensitive layer, and the $S_R$ at specified wavelength $\lambda$ is expressed as the inverse number of exposure intensity with which the cyan density becomes fog +0.5 at the application of exposure of the specified wavelength.

As a material for imparting the interlayer effect, a compound which releases a development inhibitor or its precursor by reacting with the oxidized form of a developing agent produced by development is used. Examples are a DIR (development inhibitor releasing) coupler, DIR-hydroquinone, and a coupler which releases DIR-hydroquinone or its precursor. For a development inhibitor having high diffusivity, the development inhibiting effect can be obtained regardless of the position of the donor layer in a multilayered interlayer arrangement. However, a development inhibiting effect in an unintended direction also occurs. To correct this effect, therefore, it is preferable to make the donor layer generate a color (e.g., to make the donor layer generate the same color as a layer which undergoes the influence of the undesired development inhibiting effect). Generation of magenta is preferable to obtain the spectral sensitivity of the present invention.

The size and shape of silver halide grains to be used in the layer having the interlayer effect on red-sensitive layers are not particularly restricted. It is, however, favorable to use so-called tabular grains having a high aspect ratio, a monodisperse emulsion which is uniform in grain size, or silver iodobromide grains having a layered structure of iodide. In addition, to enlarge the exposure latitude, it is preferable to mix two or more types of emulsions different in grain size.

Although the donor layer which donates the interlayer effect to a red-sensitive layer can be formed in any position on a support, it is preferable to form this layer closer to the support than a blue-sensitive layer and farther from the support than a green-sensitive layer. It is more preferable that the donor layer be located closer to the support than a yellow filter layer.

It is further preferable that the donor layer which donates the interlayer effect to a red-sensitive layer be located closer to a support than a green-sensitive layer and farther from the support than the red-sensitive layer. It is most preferable that the donor layer be located adjacent to the side of a green-sensitive layer close to a support. "Adjacent" means that there is no interlayer or the like in between.

The layer which donates the interlayer effect to a red-sensitive layer can include a plurality of layers. In that case, these layers can be either adjacent to or separated from each other.

Solid disperse dyes described in JP-A-11-305396, the disclosure of which is incorporated herein by reference can be used in the present invention.

An emulsion used in a light-sensitive material of the present invention can be any of a surface latent image type emulsion which mainly forms a latent image on the surface of a grain, an internal latent image type emulsion which forms a latent image in the interior of a grain, and another type of emulsion which has latent images on the surface and in the interior of a grain. However, the emulsion must be a negative type emulsion. The internal latent image type emulsion can be a core/shell internal latent image type emulsion described in JP-A-63-264740, the disclosure of which is incorporated herein by reference. A method of preparing this core/shell internal latent image type emulsion is described in JP-A-59-133542, the disclosure of which is incorporated herein by reference. Although the thickness of a shell of this emulsion depends on the development conditions and the like, it is preferably 3 to 40 nm, and most preferably, 5 to 20 nm.

A silver halide emulsion is normally subjected to physical ripening, chemical sensitization, and spectral sensitization before being used. Additives for use in these steps are described in Research Disclosure (RD) Nos. 17643, 18716, and 301105, and the corresponding portions are summarized in a table to be presented later.

In a light-sensitive material of the present invention, it is possible to mix, in a single layer, two or more types of emulsions different in at least one of the characteristics, i.e., the grain size, grain size distribution, halogen composition, grain shape, and sensitivity, of a sensitive silver halide emulsion.

It is also preferable to apply surface-fogged silver halide grains described in U.S. Pat. No. 4,082,553, internally fogged silver halide grains described in U.S. Pat. No. 4,626,498 and JP-A-59-214852, and colloidal silver, to light-sensitive silver halide emulsion layers and/or substantially non-light-sensitive hydrophilic colloid layers. The internally fogged or surface-fogged silver halide grain means a silver halide grain which can be developed uniformly (non-imagewise) regardless of whether the location is a non-exposed portion or an exposed portion of the light-sensitive material. A method of preparing the internally fogged or surface-fogged silver halide grain is described in U.S. Pat. No. 4,626,498 and JP-A-59-214852. A silver halide which forms the core of the internally fogged core/shell type silver halide grain can have a different halogen composition. As the internally fogged or surface-fogged silver halide, any of silver chloride, silver chlorobromide, silver iodobromide, and silver bromochloroiodide can be used. The average grain size of these fogged silver halide grains is preferably 0.01 to 0.75 $\mu$m, and most preferably, 0.05 to 0.6 $\mu$m. The grain shape can be a regular grain shape. Although the emulsion can be a polydisperse emulsion, it is preferably a monodisperse emulsion (in which at least 95% in weight, or number, of silver halide grains have grain sizes falling within the range of ±40% of the average grain size).

In the present invention, a non-light-sensitive fine-grain silver halide is preferably used. The non-light-sensitive fine-grain silver halide preferably consists of silver halide grains which are not exposed during imagewise exposure for obtaining a dye image and are not substantially developed during development. These silver halide grains are preferably not fogged in advance. In the fine-grain silver halide, the content of silver bromide is 0 to 100 mol %, and silver chloride and/or silver iodide can be added if necessary. The fine-grain silver halide preferably contains 0.5 to 10 mol % of silver iodide. The average grain size (the average value of equivalent-circle diameters of projected areas) of the fine-grain silver halide is preferably 0.01 to 0.5 μm, and more preferably, 0.02 to 2 μm.

The fine-grain silver halide can be prepared following the same procedures as for a common light-sensitive silver halide. The surface of each silver halide grain need not be optically sensitized nor spectrally sensitized. However, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this fine-grain silver halide grain-containing layer.

Although the several different additives described above are used in a light-sensitive material according to this technique, a variety of other additives can also be used in accordance with the intended use.

These additives are described in more detail in Research Disclosures Item 17643 (December, 1978), Item 18716 (November, 1979), and Item 308119 (December, 1989), the disclosures of which are incorporated herein by reference. The corresponding portions are summarized in a table below.

| | Additives | RD17643 | RD18716 |
|---|---|---|---|
| 1. | Chemical sensitizers | page 23 | page 648, right column |
| 2. | Sensitivity increasing agents | | page 648, right column |
| 3. | Spectral sensitizers, super sensitizers | pages 23–24 | page 648, right column to page 649, right column |
| 4. | Brighteners | page 24 | |
| 5. | Antifoggants and stabilizers | pages 24–25 | page 649, right column |
| 6. | Light absorbent, filter dye, ultra-violet absorbents | pages 25–26 | page 649, right column to page 650, left column |
| 7. | Stain preventing agents | page 25, right column | page 650, left to right columns |
| 8. | Dye image stabilizer | page 25 | |
| 9. | Hardening agents | page 26 | page 651, left column |
| 10. | Binder | page 26 | page 651, left column |
| 11. | Plasticizers, lubricants | page 27 | page 650, right column |
| 12. | Coating aids, surface active agents | pages 26–27 | page 650, right column |
| 13. | Antistatic agents | page 27 | page 650, right column |
| 14. | Matting agent | | |

| | Additives | RD308119 |
|---|---|---|
| 1. | Chemical sensitizers | page 996 |
| 2. | Sensitivity increasing agents | |
| 3. | Spectral sensitizers, super sensitizers | page 996, right column to page 998, right column |
| 4. | Brighteners | page 998, right column |
| 5. | Antifoggants and stabilizers | page 998, right column to page 1,000, right column |
| 6. | Light absorbent, filter dye, ultra-violet absorbents | page 1,003, left column to page 1,003, right column |
| 7. | Stain preventing agents | page 1,002, right column |
| 8. | Dye image stabilizer | page 1,002, right column |
| 9. | Hardening agents | page 1,004, right column to page 1,005, left column |
| 10. | Binder | page 1,003, right column to page 1,004, right column |
| 11. | Plasticizers, lubricants | page 1,006, left to right columns |
| 12. | Coating aids, surface active agents | page 1,005, left column to page 1,006, left column |
| 13. | Antistatic agents | page 1,006, right column to page 1,007, left column |
| 14. | Matting agent | page 1,008, left column to page 1,009, left column |

Techniques such as a layer arrangement technique, silver halide emulsions, dye forming couplers, functional couplers such as DIR couplers, various additives, and development usable in emulsions of the present invention and light-sensitive materials using the emulsions are described in European Patent No. 0565096A1 (laid open in Oct. 13, 1993) and the patents cited in it, the disclosures of which are incorporated herein by reference. The individual items and the corresponding portions are enumerated below.

1. Layer arrangements; page 61, lines 23–35, page 61, line 41–page 62, line 14
2. Interlayers: page 61, lines 36–40
3. Interlayer effect donor layers; page 62, lines 15–18
4. Silver halide halogen compositions: page 62, lines 21–25
5. Silver halide grain crystal habits: page 62, lines 26–30
6. Silver halide grain size: page 62, lines 31–34
7. Emulsion preparation methods: page 62, lines 35–40
8. Silver halide grain size distribution: page 62, lines 41–42
9. Tabular grains: page 62, lines 43–46
10. Internal structures of grains: page 62, lines 47–53
11. Latent image formation types of emulsions: page 62, line 54–page 63, line 5
12. Physical ripening and chemical sensitization of emulsions: page 63, lines 6–9
13. Use of emulsion fixtures; page 63, lines 10–13
14. Fogged emulsions: page 63, lines 14–31
15. Non-light-sensitive emulsions: page 63, lines 32–43
16. Silver coating amount: page 63, lines 49–50
17. Formaldehyde scavengers; page 64, lines 54–57
18. Mercapto-based antifoggants: page 65, lines 1–2
19. Agents releasing, e.g., fogging agent: page 65, lines 3–7
20. Dyes: page 65, lines 7–10
21. General color couplers: page 65, lines 11–13
22. Yellow, magenta, and cyan couplers: page 65, lines 14–25
23. Polymer couplers: page 65, lines 26–28
24. Diffusing dye forming couplers: page 65, lines 29–31
25. Colored couplers: page 65, lines 32–38
26. General functional couplers: page 65, lines 39–44
27. Bleaching accelerator release couplers: page 65, lines 45–48

28. Development accelerator release couplers: page 65, lines 49–53
29. Other DIR couplers: page 65, line 54–page 66, line 4
30. Coupler diffusing methods: page 66, lines 5–28
31. Antiseptic agents and mildewproofing agents: page 66, lines 29–33
32. Types of light-sensitive materials: page 66, lines 34–36
33. Light-sensitive layer film thickness and swell speed: page 66, line 40–page 67, line 1
34. Back layers: page 67, lines 3–8
35. General development processing: page 67, lines 9–11
36. Developers and developing agents: page 67, lines 12–30
37. Developer additives: page 67, lines 31–44
38. Reversal processing: page 67, lines 45–56
39. Processing solution aperture ratio: page 67, line 57–page 68, line 12
40. Development time: page 68, lines 13–15
41. Bleach-fix, bleaching, and fixing: page 68, line 16–page 69, line 31
42. Automatic processor: page 69, lines 32–40
43. Washing, rinsing, and stabilization: page 69, line 41–page 70, line 18
44. Replenishment and reuse of processing solutions: page 70, lines 19–23
45. Incorporation of developing agent into light-sensitive material: page 70, lines 24–33
46. Development temperature: page 70, lines 34–38
47. Application to film with lens: page 70, lines 39–41

It is also possible to preferably use a bleaching solution described in European Patent No. 602600, the disclosure of which is incorporated herein by reference, which contains 2-pyridinecarboxylic acid or 2,6-pyridinedicarboxylic acid, ferric salt such as ferric nitrate, and persulfate. When this bleaching solution is to be used, it is preferable to interpose a stop step and a washing step between the color development step and the bleaching step and to use organic acid such as acetic acid, succinic acid, or maleic acid as the stop bath. Furthermore, for the purposes of pH adjustment and bleaching fog, the bleaching solution preferably contains 0.1 to 2 mols/litter (litter will be referred to as "L" hereinafter) of organic acid such as acetic acid, succinic acid, maleic acid, glutaric acid, or adipic acid.

A magnetic recording layer preferably used in the present invention will be described below. This magnetic recording layer is formed by coating the surface of a support with an aqueous or organic solvent-based coating solution which is prepared by dispersing magnetic grains in a binder.

As the magnetic grains used in the present invention, it is possible to use, e.g., ferromagnetic iron oxide such as $\gamma Fe_2O_3$, Co-deposited $\gamma Fe_2O_3$, Co-deposited magnetite, Co-containing magnetite, ferromagnetic chromium dioxide, a ferromagnetic metal, a ferromagnetic alloy, Ba ferrite of a hexagonal system, Sr ferrite, Pb ferrite, and Ca ferrite. Co-deposited ferromagnetic iron oxide such as Co-deposited $\gamma Fe_2O_3$ is preferred. The grain can take the shape of any of, e.g., a needle, rice grain, sphere, cube, and plate. The specific area is preferably 20 $m^2/g$ or more, and more preferably, 30 $m^2/g$ or more as $S_{BET}$.

The saturation magnetization ($\sigma s$) of the ferromagnetic substance is preferably $3.0\times10^4$ to $3.0\times10^5$ A/m, and most preferably, $4.0\times10^4$ to $2.5\times10^5$ A/m. A surface treatment can be performed for the ferromagnetic grains by using silica and/or alumina or an organic material. Also, the surface of the ferromagnetic grain can be treated with a silane coupling agent or a titanium coupling agent as described in JP-A-6-161032, the disclosure of which is incorporated herein by reference. A ferromagnetic grain whose surface is coated with an inorganic or organic substance described in JP-A-4-259911 or JP-A-5-81652, the disclosures of which are incorporated herein by reference, can also be used.

As a binder used in the magnetic grains, it is possible to use a thermoplastic resin, thermosetting resin, radiation-curing resin, reactive resin, acidic, alkaline, or biodegradable polymer, natural polymer (e.g., a cellulose derivative and sugar derivative), and their mixtures. These examples are described in JP-A-4-219569, the disclosure of which is incorporated herein by reference. The Tg of the resin is preferably −40° C. to 300° C., and its weight average molecular weight is preferably 2,000 to 1,000,000. Examples are a vinyl-based copolymer, cellulose derivatives such as cellulosediacetate, cellulosetriacetate, celluloseacetatepropionate, celluloseacetatebutylate, and cellulosetripropionate, acrylic resin, and polyvinylacetal resin. Gelatin is also preferred. Cellulosedi(tri)acetate is particularly preferred. This binder can be hardened by the addition of an epoxy-, aziridine-, or isocyanate-based crosslinking agent. Examples of the isocyanate-based crosslinking agent are isocyanates such as tolylenediisocyanate, 4,4'-diphenylmethanediisocyanate, hexamethylenedlisocyanate, and xylylenediisocyanate, reaction products of these isocyanates and polyalcohol (e.g., a reaction product of 3 mols of tolylenediisocyanate and 1 mol of trimethylolpropane), and polyisocyanate produced by condensation of any of these isocyanates. These examples are described in JP-A-6-59357, the disclosure of which is incorporated herein by reference.

As a method of dispersing the magnetic substance in the binder, as described in JP-A-6-35092, the disclosure of which is incorporated herein by reference, a kneader, pin type mill, and annular mill are preferably used singly or together. Dispersants described in JP-A-5-088283, the disclosure of which is incorporated herein by reference, and other known dispersants can be used. The thickness of the magnetic recording layer is 0.1 to 10 $\mu$m, preferably 0.2 to 5 $\mu$m, and more preferably, 0.3 to 3 $\mu$m.

The weight ratio of the magnetic grains to the binder is preferably 0.5:100 to 60:100, and more preferably, 1;100 to 30:100. The coating amount of the magnetic grains is 0.005 to 3 $g/m^2$, preferably 0.01 to 2 $g/m^2$, and more preferably, 0.02 to 0.5 $g/m^2$. The transmission yellow density of the magnetic recording layer is preferably 0.01 to 0.50, more preferably, 0.03 to 0.20, and most preferably, 0.04 to 0.15. The magnetic recording layer can be formed in the whole area of, or into the shape of stripes on, the back surface of a photographic support by coating or printing. As a method of coating the magnetic recording layer, it is possible to use any of an air doctor, blade, air knife, squeegee, impregnation, reverse roll, transfer roll, gravure, kiss, cast, spray, dip, bar, and extrusion. A coating solution described in JP-A-5-341436, the disclosure of which is incorporated herein by reference is preferred.

The magnetic recording layer can be given a lubricating property improving function, curling adjusting function, antistatic function, adhesion preventing function, and head polishing function. Alternatively, another functional layer can be formed and these functions can be given to that layer. A polishing agent in which at least one type of grains are aspherical inorganic grains having a Mohs hardness of 5 or more is preferred. The composition of this aspherical inorganic grain is preferably an oxide such as aluminum oxide, chromium oxide, silicon dioxide, titanium dioxide, and silicon carbide, a carbide such as silicon carbide and titanium carbide, or a fine powder of diamond. The surfaces of the grains constituting these polishing agents can be treated with a silane coupling agent or titanium coupling agent.

These grains can be added to the magnetic recording layer or overcoated (as, e.g., a protective layer or lubricant layer) on the magnetic recording layer. A binder used together with the grains can be any of those described above and is preferably the same binder as in the magnetic recording layer. Light-sensitive materials having the magnetic recording layer are described in U.S. Pat. No. 5,336,589, U.S. Pat. No. 5,250,404, U.S. Pat. No. 5,229,259, U.S. Pat. No. 5,215,874, and EP 466,130, the disclosures of which are incorporated herein by reference.

A polyester support used in the present invention will be described below. Details of the polyester support and light-sensitive materials, processing, cartridges, and examples (to be described later) are described in Journal of Technical Disclosure No. 94-6023 (JIII; 1994, March 15), the disclosure of which is incorporated herein by reference. Polyester used in the present invention is formed by using diol and aromatic dicarboxylic acid as essential components. Examples of the aromatic dicarboxylic acid are 2,6-, 1,5-, 1,4-, and 2,7-naphthalenedicarboxylic acids, terephthalic acid, isophthalic acid, and phthalic acid. Examples of the diol are diethyleneglycol, triethyleneglycol, cyclohexanedimethanol, bisphenol A, and bisphenol. Examples of the polymer are homopolymers such as polyethyleneterephthalate, polyethylenenaphthalate, and polycyclohexanedimethanolterephthalate. Polyester containing 50 to 100 mol % of 2,6-naphthalenedicarboxylic acid is particularly preferred. Polyethylene-2,6-naphthalate is most preferred among other polymers. The average molecular weight ranges between about 5,000 and 200,000. The Tg of the polyester of the present invention is 50° C. or higher, preferably 90° C. or higher.

To give the polyester support a resistance to curling, the polyester support is heat-treated at a temperature of preferably 40° C. to less than Tg, and more preferably, Tg−20° C. to less than Tg. The heat treatment can be performed at a fixed temperature within this range or can be performed together with cooling. The heat treatment time is preferably 0.1 to 1500 hr, and more preferably, 0.5 to 200 hr. The heat treatment can be performed for a roll-like support or while a support is conveyed in the form of a web. The surface shape can also be improved by roughening the surface (e.g., coating the surface with conductive inorganic fine grains such as $SnO_2$ or $Sb_2O_5$). It is desirable to knurl and slightly raise the end portion, thereby preventing the cut portion of the core from being photographed. These heat treatments can be performed in any stage after support film formation, after surface treatment, after back layer coating (e.g., an antistatic agent or lubricating agent), and after undercoating. A favorable timing is after the antistatic agent is coated.

An ultraviolet absorbent can be incorporated into this polyester. Also, to prevent light piping, dyes or pigments such as Diaresin manufactured by Mitsubishi Kasei Corp. or Kayaset manufactured by NIPPON KAYAKU CO. LTD. commercially available for polyester can be incorporated.

In the present invention, it is preferable to perform a surface treatment in order to adhere the support and the light-sensitive material constituting layers. Examples of the surface treatment are surface activation treatments such as a chemical treatment, mechanical treatment, corona discharge treatment, flame treatment, ultraviolet treatment, high-frequency treatment, glow discharge treatment, active plasma treatment, laser treatment, mixed acid treatment, and ozone oxidation treatment. Among other surface treatments, the ultraviolet radiation treatment, flame treatment, corona treatment, and glow treatment are preferred.

An undercoat layer can include a single layer or two or more layers. Examples of an undercoat layer binder are copolymers formed by using, as a starting material, a monomer selected from vinyl chloride, vinylidene chloride, butadiene, methacrylic acid, acrylic acid, itaconic acid, and maleic anhydride. Other examples are polyethyleneimine, an epoxy resin, grafted gelatin, nitrocellulose, and gelatin. Resorcin and p-chlorophenol are examples of a compound which swells a support. Examples of a gelatin hardener added to the undercoat layer are chromium salt (e.g., chromium alum), aldehydes (e.g., formaldehyde and glutaraldehyde), isocyanates, an active halogen compound (e.g., 2,4-dichloro-6-hydroxy-s-triazine), an epichlorohydrin resin, and an active vinylsulfone compound. $SiO_2$, $TiO_2$, inorganic fine grains, or polymethylmethacrylate copolymer fine grains (0.01 to 10 $\mu$m) can also be contained as a matting agent.

In the present invention, an antistatic agent is preferably used. Examples of this antistatic agent are carboxylic acid, carboxylate, a macromolecule containing sulfonate, cationic macromolecule, and ionic surfactant compound.

As the antistatic agent, it is most preferable to use fine grains of at least one crystalline metal oxide selected from ZnO, $TiO_2$, $SnO_2$, $Al_2O_3$, $In_2O_3$, $SiO_2$, MgO, BaO, $MoO_3$, and $V_2O_5$, and having a volume resistivity of preferably $10^7$ Ω·cm or less, and more preferably, $10^5$ Ω·cm or less and a grain size of 0.001 to 1.0 $\mu$m, fine grains of composite oxides (e.g., Sb, P, B, In, S, Si, and C) of these metal oxides, fine grains of sol metal oxides, or fine grains of composite oxides of these sol metal oxides.

The content in a light-sensitive material is preferably 5 to 500 mg/m$^2$, and particularly preferably, 10 to 350 mg/m$^2$. The ratio of a conductive crystalline oxide or its composite oxide to the binder is preferably 1/300 to 100/1, and more preferably, 1/100 to 100/5.

A light-sensitive material of the present invention preferably has a slip property. Slip agent-containing layers are preferably formed on the surfaces of both a light-sensitive layer and back layer. A preferable slip property is 0.01 to 0.25 as a coefficient of kinetic friction. This represents a value obtained when a stainless steel sphere 5 mm in diameter is conveyed at a speed of 60 cm/min (25° C., 60% RH). In this evaluation, a value of nearly the same level is obtained when the surface of a light-sensitive layer is used as a sample to be measured.

Examples of a slip agent usable in the present invention are polyorganocyloxane, higher fatty acid amide, higher fatty acid metal salt, and ester of higher fatty acid and higher alcohol. As the polyorganocyloxane, it is possible to use, e.g., polydimethylcyloxane, polydiethylcyloxane, polystyrylmethylcyloxane, or polymethylphenylcyloxane. A layer to which the slip agent is added is preferably the outermost emulsion layer or back layer. Polydimethylcyloxane or ester having a long-chain alkyl group is particularly preferred.

A light-sensitive material of the present invention preferably contains a matting agent. This matting agent can be added to either the emulsion surface or back surface and is most preferably added to the outermost emulsion layer. The matting agent can be either soluble or insoluble in processing solutions, and the use of both types of matting agents is preferred. Favorable examples are polymethylmethacrylate grains, poly(methylmethacrylate/methacrylic acid=9/1 or 5/5 (molar ratio)) grains, and polystyrene grains. The grain size is preferably 0.8 to 10 μm, and a narrow grain size distribution is favored. It is preferable that 90% or more of all grains have grain sizes 0.9 to 1.1 times the average grain size. To increase the matting property, it is preferable to simultaneously add fine grains with a grain size of 0.8 μm or smaller. Examples are polymethylmethacrylate grains (0.2 μm), poly(methylmethacrylate/methacrylic acid=9/1 (molar ratio, 0.3 μm) grains, polystyrene grains (0.25 μm), and colloidal silica grains (0.03 μm).

A film cartridge used in the present invention will be described below. The principal material of the cartridge used in the present invention can be a metal or synthetic plastic.

Preferable plastic materials are polystyrene, polyethylene, polypropylene, and polyphenylether. The cartridge of the present invention can also contain various antistatic agents. For this purpose, carbon black, metal oxide grains, nonion-, anion-, cation-, and betaine-based surfactants, or a polymer can be preferably used. These cartridges subjected to the antistatic treatment are described in JP-A-1-312537 and JP-A-1-3125385 the disclosures of which are incorporated herein by reference. It is particularly preferable that the resistance be $10^{12}$ Ω or less at 25° C. and 25% RH. Commonly, plastic cartridges are manufactured by using plastic into which carbon black or a pigment is incorporated in order to give a light-shielding property. The cartridge size can be a presently available 135 size. To miniaturize cameras, it is effective to decrease the diameter of a 25-mm cartridge of 135 size to 22 mm or less. The volume of a cartridge case is 30 $cm^3$ or less, preferably 25 $cm^3$ or less. The weight of plastic used in the cartridge and the cartridge case is preferably 5 to 15 g.

Furthermore, a cartridge which feeds a film by rotating a spool can be used in the present invention. It is also possible to use a structure in which a film leader is housed in a cartridge main body and fed through a port of the cartridge to the outside by rotating a spool shaft in the film feed direction. These structures are disclosed in U.S. Pat. No. 4,834,306 and U.S. Pat. No. 5,226,613, the disclosures of which are incorporated herein by reference. Photographic films used in the present invention can be so-called raw films before being developed or developed photographic films. Also, raw and developed photographic films can be accommodated in the same new cartridge or in different cartridges.

A color photographic light-sensitive material of the present invention is also suitably used as a negative film for Advanced Photo System (to be referred to as APS hereinafter). Examples are the NEXIA A, NEXIA F, and NEXIA H (ISO 200, 100, and 400, respectively) manufactured by Fuji Photo Film Co., Ltd. (to be referred to as Full Film hereinafter). These films are so processed as to have an APS format and set in an exclusive cartridge. These APS cartridge films are loaded into APS cameras such as the Fuji Film EPION Series (e.g., the EPION 300Z).

A color photosensitive film of the present invention is also suited as a film with lens such as the Fuji Film FUJICOLOR UTSURUNDESU SUPER SLIM or the UTSURUNDESU ACE 800.

A photographed film is printed through the following steps in a mini-lab system.

(1) Reception (an exposed cartridge film is received from a customer)

(2) Detaching step (the film is transferred front the cartridge to an intermediate cartridge for development)

(3) Film development (4) Reattaching step (the developed negative film is returned to the original cartridge)

(5) Printing (prints of three types C, H, and P and an index print are continuously automatically printed on color paper [preferably the Fuji Film SUPER FA8])

(6) Collation and shipment (the cartridge and the index print are collated by an ID number and shipped together with the prints)

As these systems, the Fuji Film MINI-LAB CHAMPION SUPER FA-298, FA-278, FA-258, FA-238 and the Fuji Film FRONTIER digital lab system are preferred. Examples of a film processor for the MINI-LAB CHAMPION are the FP922AL, FP562B, FP562B,AL, FP362B, and FP362B,AL, and recommended processing chemicals are the FUJICOLOR JUST-IT CN-16L and CN-16Q. Examples of a printer processor are the PP3008AR, PP3008A, PP1828AR, PP1828A, PP1258AR, PP1258A, PP728AR, and PP728A, and a recommended processing chemicals are the FUJICOLOR JUST-IT CP-47L and CP-40FAII.

In the FRONTIER system, the SP-1000 scanner 6 image processor and the LP-1000P laser printer & paper processor or the LP-1000W laser printer are used. A detacher used in the detaching step and a reattacher used in the reattaching step are preferably the Fuji Film DT200 or DT100 and AT200 or AT100, respectively.

APS can also be enjoyed by PHOTO JOY SYSTEM whose main component is the Fuji Film Aladdin 1000 digital image workstation. For example, a developed APS cartridge film is directly loaded into the Aladdin 1000, or image information of a negative film, positive film, or print is input to the Aladdin 1000 by using the FE-550 35-mm film scanner or the PE-550 flat head scanner. Obtained digital image data can be easily processed and edited. This data can be printed out by the NC-550AL digital color printer using a photo-fixing heat-sensitive color printing system or the PICTOROGRAPHY 3000 using a laser exposure thermal development transfer system, or by existing laboratory equipment through a film recorder. The Aladdin 1000 can also output digital information directly to a floppy disk or Zip disk or to an CD-R via a CD writer.

In a home, a user can enjoy photographs on a TV set simply by loading a developed APS cartridge film into the Fuji Film PHOTO PLAYER AP-1. Image information can also be continuously input to a personal computer by loading a developed APS cartridge film into the Fuji Film PHOTO SCANNER AS-1. The Fuji Film PHOTO VISION FV-10 or FV-5 can be used to input a film, print, or three-dimensional object. Furthermore, image information recorded in a floppy disk, Zip disk, CR-R, or hard disk can be variously processed on a computer by using the Fuji Film PHOTO FACTORY application software. The Fuji Film NC-2 or NC-2D digital color printer using a photo-fixing heat-sensitive color printing system is suited to outputting high-quality prints from a personal computer.

To keep developed APS cartridge films, the FUJICOLOR POCKET ALBUM AP-5 POP L, AP-1 POP L, or AP-1 POP KG, or the CARTRIDGE FILE 16 is preferred.

Examples of the present invention will be described below. However, the present invention is not limited to these examples.

EXAMPLE 1

The silver halide emulsions Em-A to Em-O listed in Table 1 were prepared with reference to the process for preparing emulsions Em-A to Em-O as described in Example 1 of JP-A-2001-281815.

TABLE 1

| Emulsion name | Average silver iodide Content (mol %) | Average equivalent-sphere diameter (μm) | Average aspect ratio | Average equivalent-circle diameter (μm) | Average grain thickness (μm) | Shape |
|---|---|---|---|---|---|---|
| Em-A | 4 | 1.0 | 25 | 2.8 | 0.11 | Tabular |
| Em-B | 5 | 0.7 | 15 | 1.6 | 0.11 | Tabular |
| Em-C | 4.7 | 0.51 | 7 | 0.85 | 0.12 | Tabular |
| Em-D | 1 | 0.51 | 11 | 1.0 | 0.09 | Tabular |
| Em-E | 5 | 1.0 | 25 | 2.8 | 0.11 | Tabular |
| Em-F | 5.5 | 0.75 | 15 | 1.6 | 0.11 | Tabular |
| Em-G | 4.7 | 0.73 | 9.9 | 1.39 | 0.14 | Tabular |
| Em-H | 2.5 | 0.51 | 9 | 0.42 | 0.10 | Tabular |
| Em-I | 1.5 | 0.37 | 9 | 0.67 | 0.074 | Tabular |
| Em-J | 5 | 0.8 | 12 | 1.6 | 0.13 | Tabular |
| Em-K | 3.7 | 0.47 | 3 | 0.53 | 0.18 | Tabular |
| Em-L | 5.5 | 1.6 | 12 | 3.2 | 0.27 | Tabular |
| Em-M | 8.8 | 0.64 | 5.2 | 0.85 | 0.16 | Tabular |
| Em-N | 3.7 | 0.37 | 4.6 | 0.55 | 0.12 | Tabular |
| Em-O | 1.8 | 0.19 | — | — | — | Cubic |

In the tabular grains of Table 1, dislocation lines as described in JP-A-3-237450 are observed through a high-voltage electron microscope.

(Preparation of Sample 001)

Muiltilayer coating of a triacetylcellulose support was effected with the following compositions, thereby obtaining a color negative film (sample 001).

(Compositions of Light-Sensitive Layers)

The main materials used in the individual layers are classified as follows.

ExC: Cyan coupler UV: Ultraviolet absorbent

ExM: Magenta coupler HBS: High-boiling organic solvent

ExY: Yellow coupler H: Gelatin hardener (In the following description, practical compounds have numbers attached to their symbols. Formulas of these compounds will be presented later.)

The number corresponding to each component indicates the coating amount in units of g/m$^2$. The coating amount of a silver halide is indicated by the amount of silver.

| | | |
|---|---|---|
| 1st layer (1st antihalation layer) | | |
| Black colloidal silver | silver | 0.127 |
| 0.07 μm silver iodobromide emulsion (Content of silver iodide: 2 mol %) | silver | 0.008 |
| Gelatin | | 0.900 |
| ExC-1 | | 0.002 |
| ExC-3 | | 0.002 |
| Cpd-2 | | 0.001 |
| HBS-1 | | 0.005 |
| HBS-2 | | 0.002 |
| F-8 | | 0.001 |
| 2nd layer (2nd antihalation layer) | | |
| Black colloidal silver | silver | 0.019 |
| Gelatin | | 0.425 |
| ExM-1 | | 0.002 |
| Solid disperse dye ExF-9 | | 0.120 |
| HBS-1 | | 0.074 |
| F-8 | | 0.001 |
| 3rd layer (Interlayer) | | |
| Cpd-1 | | 0.080 |
| HBS-1 | | 0.042 |

-continued

| | | |
|---|---|---|
| Gelatin | | 0.300 |
| 4th layer (Low-speed red-sensitive emulsion layer) | | |
| Em-D | silver | 0.407 |
| Em-C | silver | 0.457 |
| ExC-1 | | 0.233 |
| ExC-2 | | 0.026 |
| ExC-3 | | 0.129 |
| ExC-4 | | 0.155 |
| ExC-5 | | 0.029 |
| ExC-6 | | 0.013 |
| Cpd-2 | | 0.025 |
| Cpd-4 | | 0.025 |
| ExC-8 | | 0.050 |
| HBS-1 | | 0.114 |
| HBS-5 | | 0.038 |
| Gelatin | | 1.474 |
| 5th layer (Medium-speed red-sensitive emulsion layer) | | |
| Em-B | silver | 0.601 |
| Em-C | silver | 0.301 |
| ExC-1 | | 0.154 |
| ExC-2 | | 0.037 |
| ExC-3 | | 0.018 |
| ExC-4 | | 0.103 |
| ExC-5 | | 0.037 |
| ExC-6 | | 0.030 |
| Cpd-2 | | 0.036 |
| Cpd-4 | | 0.028 |
| Cpd-6 | | 0.060 |
| ExC-7 | | 0.010 |
| HBS-1 | | 0.129 |
| Gelatin | | 1.086 |
| 6th layer (High-speed red-sensitive emulsion layer) | | |
| Em-A | silver | 0.950 |
| ExC-1 | | 0.072 |
| ExC-3 | | 0.035 |
| ExC-10 | | 0.080 |
| Cpd-2 | | 0.064 |
| Cpd-4 | | 0.077 |
| Cpd-6 | | 0.060 |
| ExC-7 | | 0.040 |
| HBS-1 | | 0.329 |
| HBS-2 | | 0.120 |
| Gelatin | | 1.245 |
| 7th layer (Interlayer) | | |
| Cpd-1 | | 0.094 |
| Cpd-9 | | 0.369 |
| Solid disperse dye ExF-4 | | 0.030 |
| HBS-1 | | 0.049 |

-continued

| | | |
|---|---|---|
| Polyethylacrylate latex | | 0.088 |
| Gelatin | | 0.886 |
| 8th layer (layer for donating interlayer effect to red-sensitive layer) | | |
| Em-J | silver | 0.300 |
| Em-K | silver | 0.200 |
| Cpd-4 | | 0.030 |
| ExM-2 | | 0.057 |
| ExM-3 | | 0.016 |
| ExM-4 | | 0.051 |
| ExY-1 | | 0.008 |
| ExY-6 | | 0.042 |
| ExC-9 | | 0.011 |
| HBS-1 | | 0.090 |
| HBS-3 | | 0.003 |
| HBS-5 | | 0.030 |
| Gelatin | | 0.610 |
| 9th layer (Low-speed green-sensitive emulsion layer) | | |
| Em-H | silver | 0.200 |
| Em-G | silver | 0.220 |
| Em-I | silver | 0.130 |
| ExM-2 | | 0.378 |
| ExM-3 | | 0.047 |
| ExY-1 | | 0.009 |
| ExC-9 | | 0.007 |
| HBS-1 | | 0.098 |
| HBS-3 | | 0.010 |
| HBS-4 | | 0.077 |
| HBS-5 | | 0.548 |
| Cpd-5 | | 0.010 |
| Gelatin | | 1.470 |
| 10th layer (Medium-speed green-sensitive emulsion layer) | | |
| Em-F | silver | 0.536 |
| ExM-2 | | 0.049 |
| ExM-3 | | 0.035 |
| ExM-4 | | 0.014 |
| ExY-1 | | 0.003 |
| ExY-5 | | 0.006 |
| ExC-6 | | 0.007 |
| ExC-8 | | 0.010 |
| ExC-9 | | 0.012 |
| HBS-1 | | 0.065 |
| HBS-3 | | 0.002 |
| HBS-5 | | 0.020 |
| Cpd-5 | | 0.004 |
| Gelatin | | 0.446 |
| 11th layer (High-speed green-sensitive emulsion layer) | | |
| Em-E | silver | 0.493 |
| Em-G | silver | 0.440 |
| ExC-6 | | 0.002 |
| ExC-7 | | 0.010 |
| ExM-1 | | 0.022 |
| ExM-2 | | 0.045 |
| ExM-3 | | 0.014 |
| ExM-4 | | 0.010 |
| ExM-5 | | 0.010 |
| Cpd-3 | | 0.004 |
| Cpd-4 | | 0.007 |
| Cpd-5 | | 0.010 |
| HBS-1 | | 0.148 |
| HBS-5 | | 0.037 |
| Polyethylacrylate latex | | 0.099 |
| Gelatin | | 0.939 |
| 12th layer (Yellow filter layer) | | |
| Cpd-1 | | 0.094 |
| Solid disperse dye ExF-2 | | 0.150 |
| Solid disperse dye ExF-5 | | 0.010 |
| Oil-soluble dye ExF-7 | | 0.010 |
| HBS-1 | | 0.049 |
| Gelatin | | 0.630 |

-continued

| | | |
|---|---|---|
| 13th layer (Low-speed blue-sensitive emulsion layer) | | |
| Em-O | silver | 0.060 |
| Em-M | silver | 0.404 |
| Em-N | silver | 0.076 |
| ExC-1 | | 0.048 |
| ExY-1 | | 0.012 |
| ExY-2 | | 0.350 |
| ExY-6 | | 0.060 |
| ExY-7 | | 0.300 |
| ExC-9 | | 0.012 |
| Cpd-2 | | 0.100 |
| Cpd-3 | | 0.004 |
| HBS-1 | | 0.222 |
| HBS-5 | | 0.074 |
| Gelatin | | 2.058 |
| 14th layer (High-speed blue-sensitive emulsion layer) | | |
| Em-L | silver | 0.974 |
| ExY-2 | | 0.100 |
| ExY-7 | | 0.100 |
| Cpd-2 | | 0.075 |
| Cpd-3 | | 0.001 |
| HBS-1 | | 0.071 |
| Gelatin | | 0.678 |
| 15th layer (1st protective layer) | | |
| 0.07-μm silver iodobromide emulsion (Content of silver iodide: 2 mol %) | silver | 0.280 |
| UV-1 | | 0.100 |
| UV-2 | | 0.060 |
| UV-3 | | 0.095 |
| UV-4 | | 0.013 |
| UV-5 | | 0.200 |
| F-11 | | 0.009 |
| S-1 | | 0.086 |
| HBS-1 | | 0.175 |
| HBS-4 | | 0.050 |
| Gelatin | | 1.984 |
| 16th layer (2nd protective layer) | | |
| H-1 | | 0.400 |
| B-1 (diameter 1.7 μm) | | 0.050 |
| B-2 (diameter 1.7 μm) | | 0.150 |
| B-3 | | 0.050 |
| W-5 | | 0.025 |
| W-1 | | $9.0 \times 10^{-3}$ |
| S-1 | | 0.200 |
| Gelatin | | 0.750 |

In addition to the above components, to improve the storage stability, processability, resistance to pressure, antiseptic and mildewproofing properties, antistatic properties, and coating properties, the individual layers contained B-4 to B-6, F-1 to F-17, lead salt, platinum salt, iridium salt, and rhodium salt.

Preparation of Dispersions of Organic Solid Disperse Dyes

ExF-2 in the 12th layer was dispersed by the following method.

| | |
|---|---|
| Wet cake (containing 17.6 mass % of water) of ExF-2 | 2.800 kg |
| Sodium octylphenyldiethoxymethane sulfonate (31 mass % aqueous solution) | 0.376 kg |
| F-15 (7% aqueous solution) | 0.011 kg |
| Water | 4.020 kg |
| Total (pH was adjusted to 7.2 by NaOH) | 7.210 kg |

A slurry having the above composition was coarsely dispersed by stirring by using a dissolver. The resultant material was dispersed at a peripheral speed of 10 m/s, a discharge amount of 0.6 kg/min, and a packing ratio of 0.3-mm diameter zirconia beads of 80% by using an agitator mill until the absorbance ratio of the dispersion was 0.29, thereby obtaining a solid fine-grain dispersion. The average grain size of the fine dye grains was 0.29 μm.

Following the same procedure as above, solid dispersions of ExF-4 and ExF-9 were obtained. The average grain sizes of the fine dye grains were 0.28 and 0.49 μm, respectively. ExF-5 was dispersed by a microprecipitation dispersion method described in Example 1 of EF549,489A, the disclosure of which is incorporated herein by reference. The average grain size was found to be 0.06 μm.

Compounds used in the formation of each layer were as follows.

ExC-1

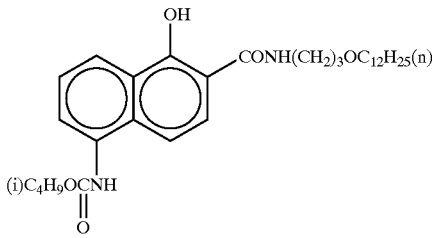

ExC-2

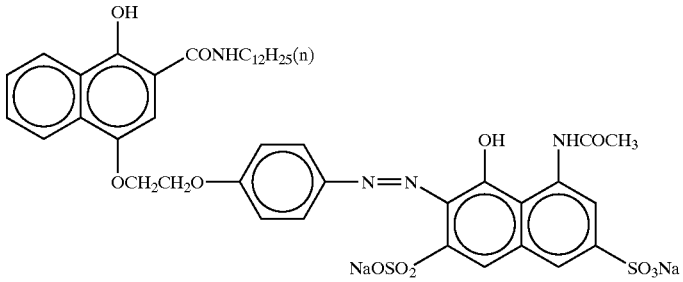

ExC-3

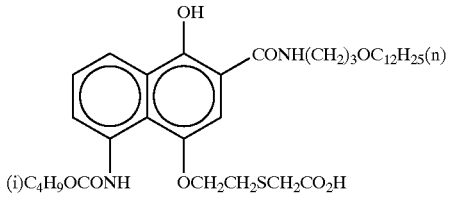

ExC-4

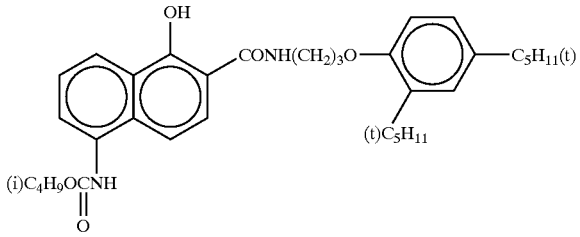

ExC-5

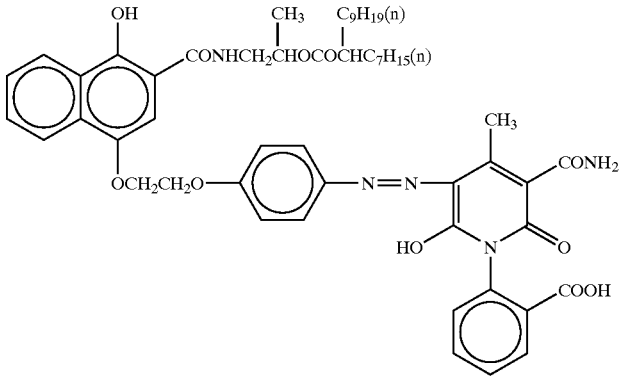

-continued
ExC-6
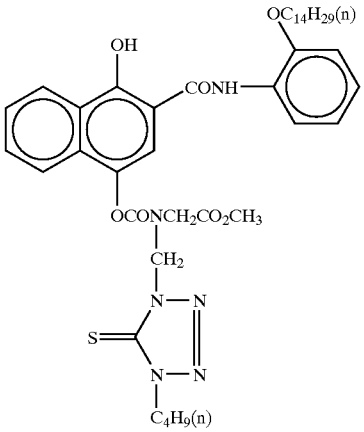
ExC-7
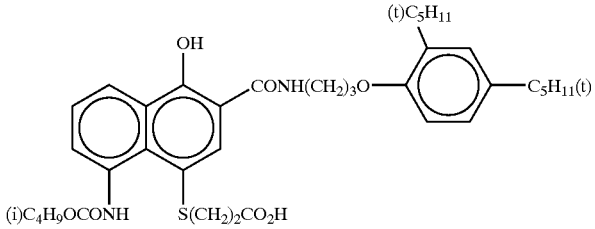
ExC-8
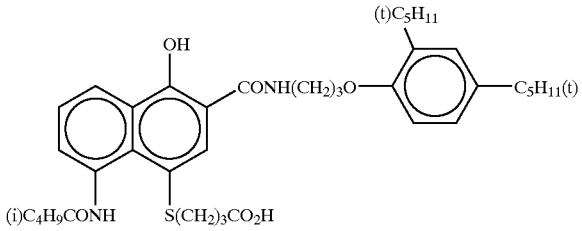
ExC-9
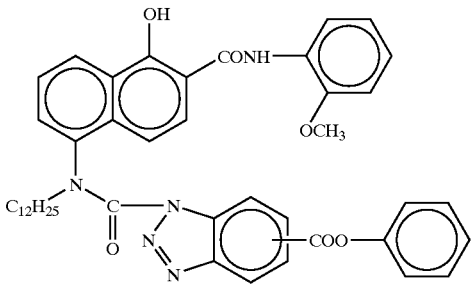
ExC-10
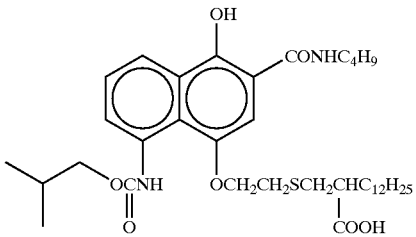

-continued
ExM-1
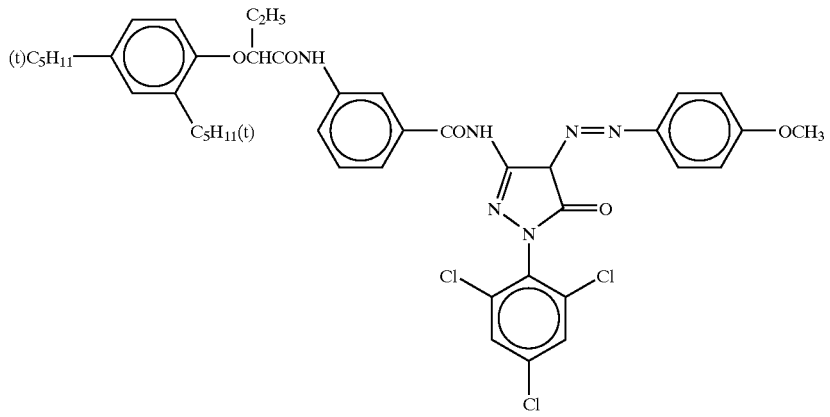
ExM-5
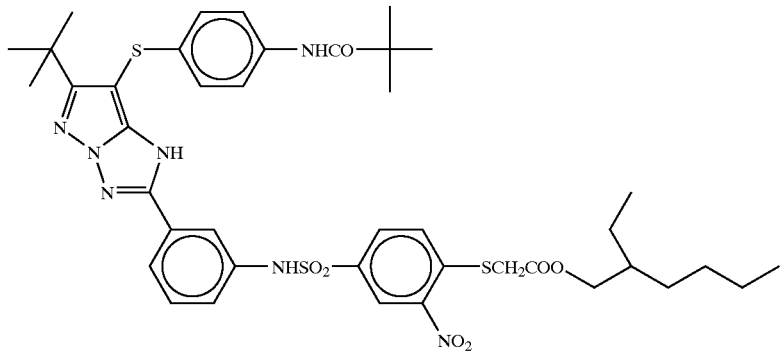
ExM-2
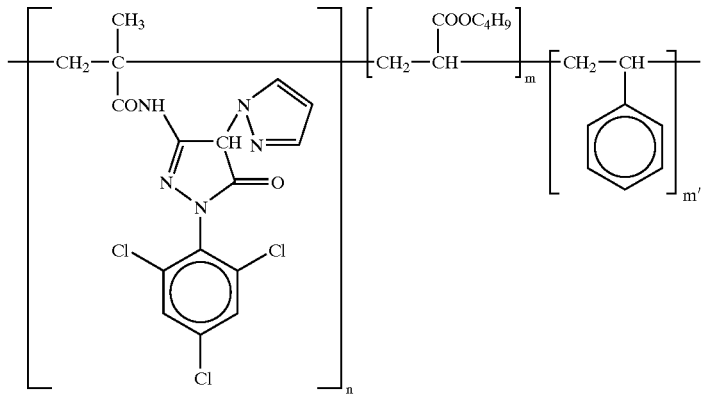
n = 50
m = 25
m′ = 25
mol. wt. about 20,000

-continued
ExM-3
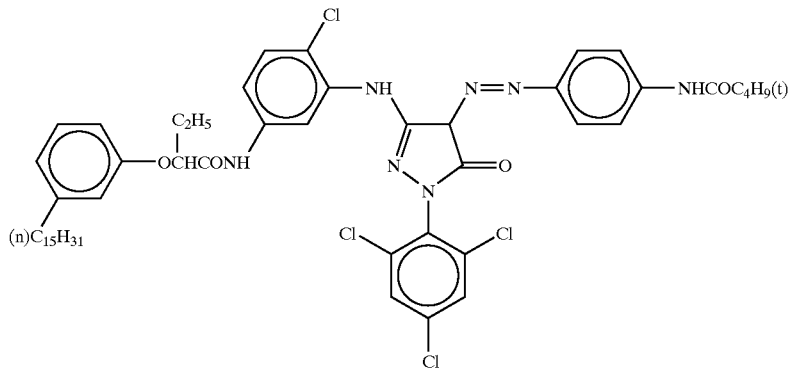
ExM-4
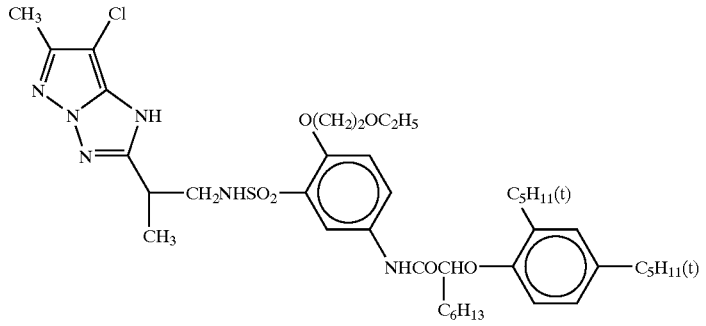
ExY-1
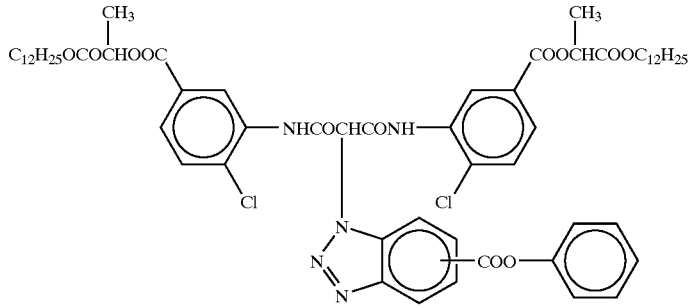
ExY-2
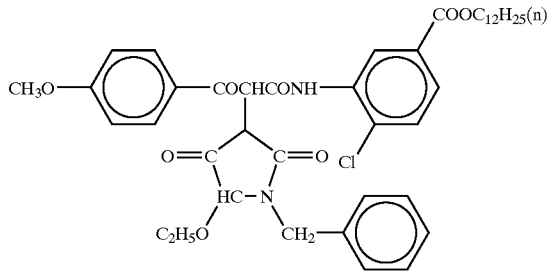

-continued
ExY-5
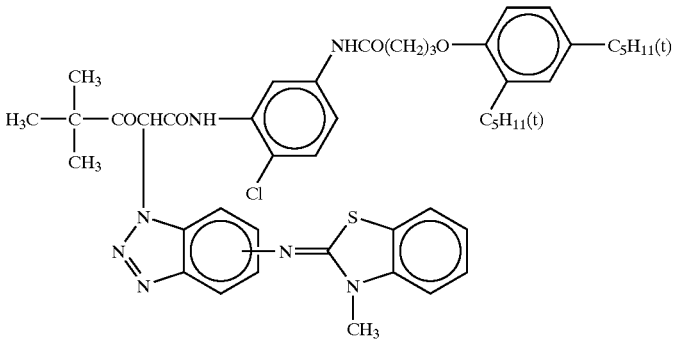
ExY-6
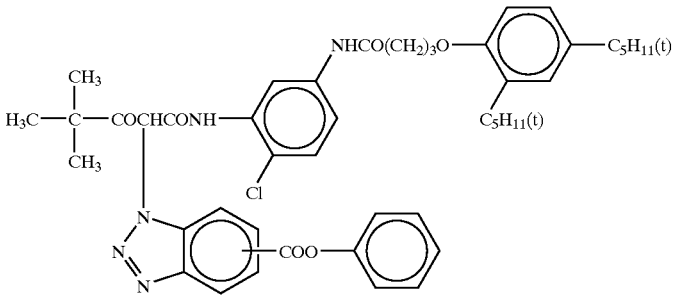
ExY-7
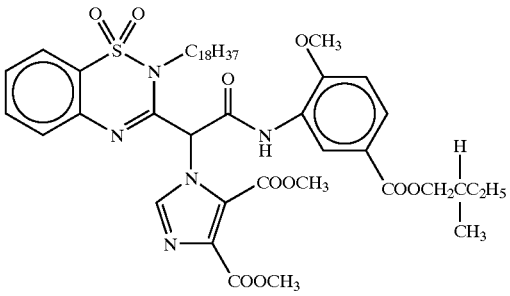
Cpd-1
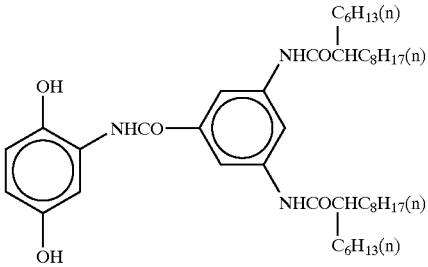
Cpd-2
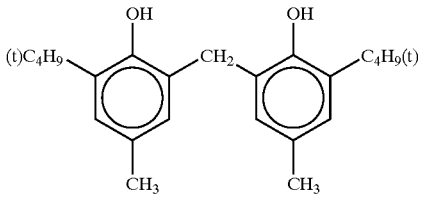

-continued
Cpd-3
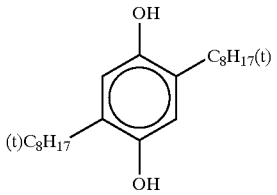
Cpd-4 $n\text{-}C_{14}H_{29}OCOCH_2CH_2CONOH$
$CH_3$
Cpd-5
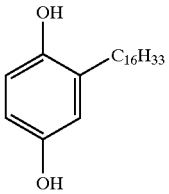
Cpd-6
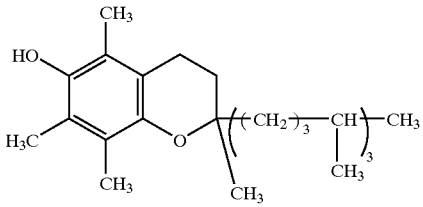
UV-1
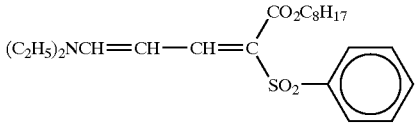
UV-2
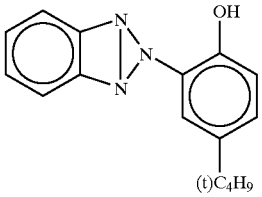
UV-3
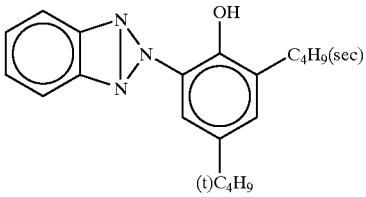
UV-4
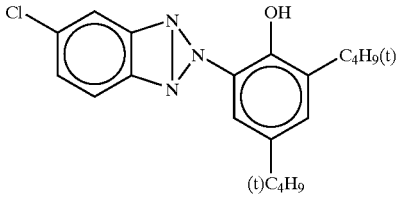

-continued
UV-5
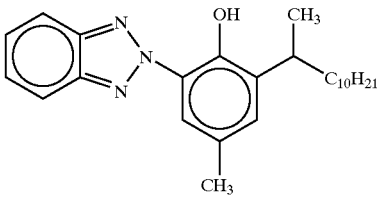
B-1
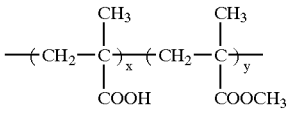
x/y = 10/90 (mass ratio)
Weight-average molecular weight: about: 35,000
B-2
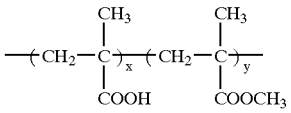
x/y = 40/60 (mass ratio)
Weight-average molecular weight: about: 20,000
B-3
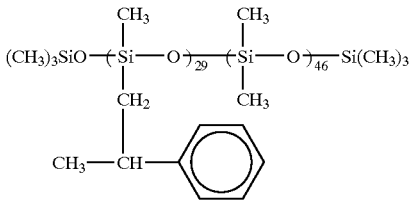
(mole ratio)
Weight-average molecular weight: about: 8,000
H-1
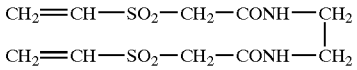
S-1
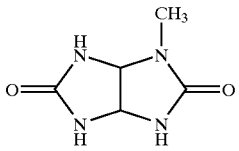
HBS-1 Tricresyl phosphate
HBS-2 Di-n-butyl phthalate
HBS-3
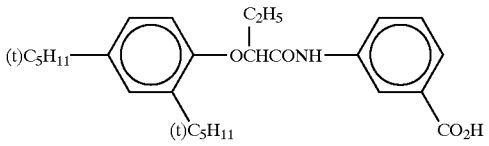
HBS-4 Tri (2-ethylhexyl) phosphate
HBS-5
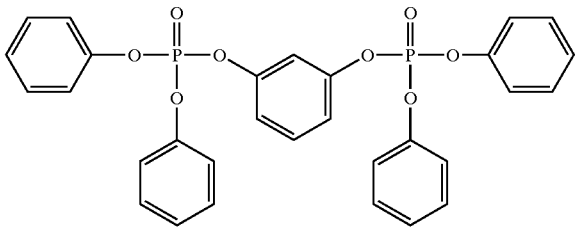
F-1
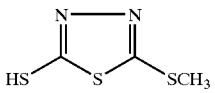

-continued
F-2
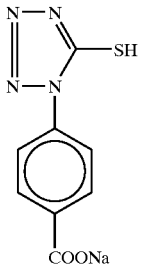
F-3
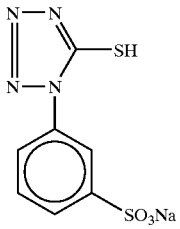
F-4
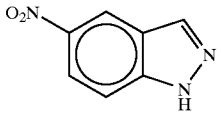
F-5
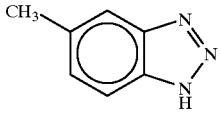
F-6
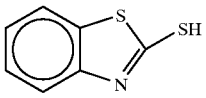
F-7
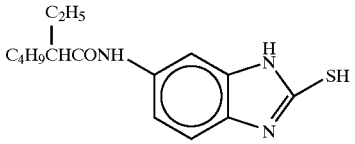
F-8
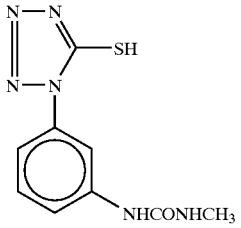
F-9
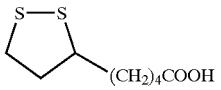
F-10
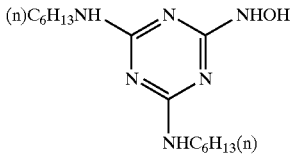

-continued
F-11
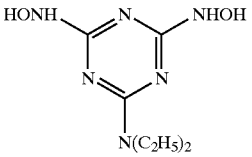
F-12
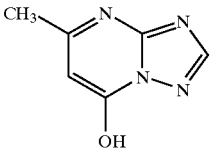
F-13
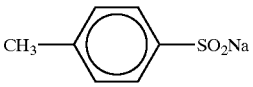
F-14
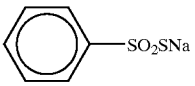
F-15
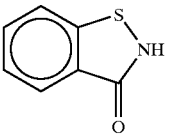
F-16
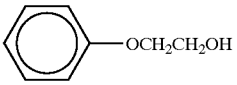
F-17
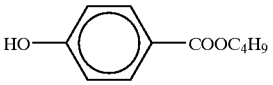
W-1
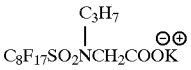
W-5
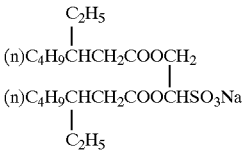
W-6 $C_8F_{17}SO_3Li$
B-4
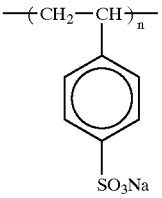
Weight-average molecular weight: about: 750,000
B-5
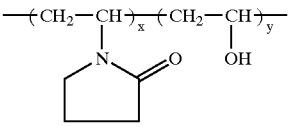
x/y = 70/30 (mass ratio)
Weight-average molecular weight: about: 17,000

-continued
B-6
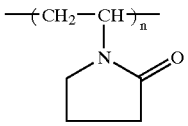
Weight-average molecular weight: about: 10,000
Cpd-7
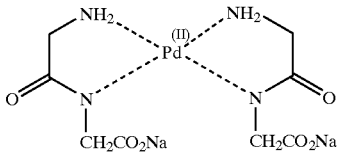
ExF-1
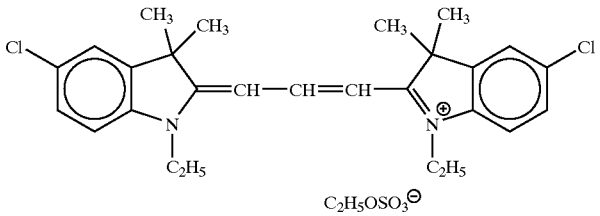
ExF-2
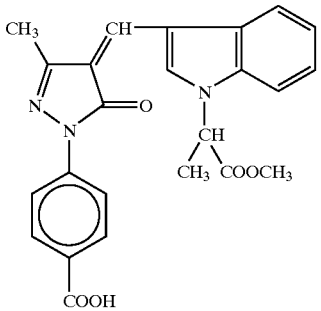
ExF-4
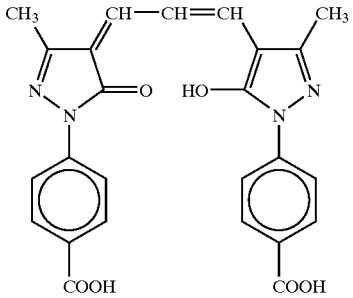
ExF-5
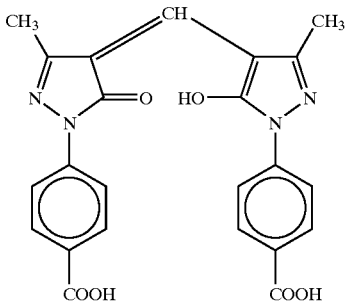

-continued

ExF-7

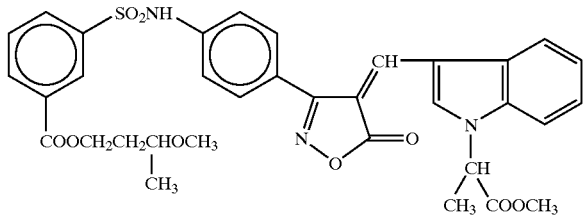

ExF-9

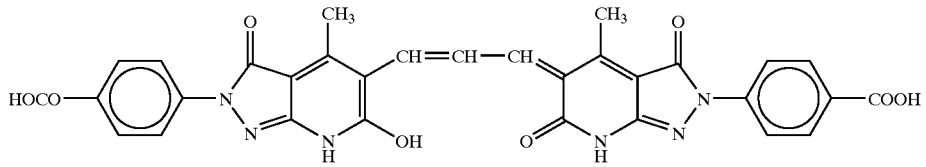

The thus prepared color negative lightsensitive material is referred to as sample 001.

The obtained sample was evaluated by a charge conditioning capability test and a high speed coatability test.

(Evaluation by Charge Conditioning Capability Test)

Each sample was wrought into 135-format, placed in a film cartridge and charged in a camera. High-speed winding was performed in an atmosphere of 15° C. temperature and 15% humidity, and film development was carried out by the following processing. With respect to fog on the developed film, visual inspection was performed.

(Evaluation by High Speed Coatability Test)

The 16-th layer in which the particle diameter of B-1 was 3 μm was applied at a speed of 1 m/sec in accordance with the slide bead coating method arid immediately dried. The number of crawlings having occurred on the coating film surface was visually counted and assessed in terms of crawling degree. The crawling degree refers to the percentage of the number of crawlings of each of the samples based on the number of crawlings of the sample 001. When the crawling degree was not higher than 100, it was judged that a crawling inhibiting effect was exerted.

The processing steps and the processing solution compositions are presented below.

(Processing steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60.0° C. | | |

*The replenishment rate was per 1.1 m of a 35-mm wide light-sensitive material (equivalent to one 24 Ex. 1)

The stabilizer and fixer were returned from (2) to (1) by counterflow, and the overflow of washing water was entirely introduced to the fixing bath (2), Note that the amounts of the developer, bleaching solution, and fixer carried over to the bleaching step, fixing step, and washing step were 2.5 mL, 2.0 mL, and 2.0 μL, respectively, per 1.1 m of a 35-nm wide light-sensitive material. Note also that each crossover time was 6 sec, and this time was included in the processing time of each preceding step.

The aperture areas of the processor were 100 $cm^2$ for the color developer, 120 $cm^2$ for the bleaching solution, and about 100 $cm^2$ for the other processing solutions.

The compositions of the processing solutions are presented below.

| | Tank solution (g) | Replenisher (g) |
|---|---|---|
| (Color developer) | | |
| Diethylenetriamine pentaacetic acid | 3.0 | 3.0 |
| Disodium cathecol-3,5-disulfonate | 0.3 | 0.3 |
| Sodium sulfite | 3.9 | 5.3 |
| Potassium carbonate | 39.0 | 39.0 |
| Disodium-N,N-bis(2-sulfonateethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7-tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0 L |
| pH (adjusted by potassium hydroxide and sulfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |

-continued

| | Tank solution (g) | Replenisher (g) |
|---|---|---|
| Water to make | 1.0 L | 1.0 L |
| pH (adjusted by ammonia water) | 4.6 | 4.0 |
| (Fixing (1) tank solution) | | |

A 5:95 (volume ratio) mixture of the above bleaching tank solution and the following fixing tank solution (pH 6.8).

| (Fixing (2)) | Tank solution (g) | Replenisher (g) |
|---|---|---|
| Aqueous ammonium thiosulfate solution (750 g/L) | 240 mL | 720 mL |
| Imidazole | 7 | 21 |
| Ammonium methane thiosulfonate | 5 | 15 |
| Ammonium methane sulfinate | 10 | 30 |
| Ethylenediamine tetraacetic acid | 13 | 39 |
| Water to make | 1.0 L | 1.0 L |
| pH (adjusted by ammonia water and acetic acid) | 7.4 | 7.45 |
| (Washing water) | | |

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) common to tank solution and replenisher | (g) |
|---|---|
| Sodium p-toluenesulfinate | 0.03 |
| Polyoxyethylene-p-monononylphenylether (average polymerization degree 10) | 0.2 |
| 1,2-benzolsothiazoline-3-one.sodium | 0.10 |
| Disodium ethylenediaminetetraacetate | 0.05 |
| 1,2,4-triazole | 1.3 |
| 1,4-bis(1,2,4-triazole-1-isomethyl) piperazine | 0.75 |
| Water to make | 1.0 L |
| pH | 8.5 |

(Preparation of Samples 002 to 027)

The process for preparing the sample 001 was changed as follows.

Samples 002 to 027 each having a spectral sensitivity of blue-sensitive layer as specified in Table 2 were prepared by effecting an equal-mass change of compound W-1 to compounds listed in Table 2 with respect to the 16th layer (second protective layer) and by changing the amount of compounds UV-1 to −5 and 007 μm silver iodobromide emulsion in the 15th layer (first protective layer) to thereby changing the spectral sensitivity in the ultraviolet region. In order to measure the spectral sensitivity, the spectral sensitivity distribution curve at the density region of Dmin+0.4 was formed, and the relative sensitivity of the material at a wavelength of 370 nm with respect to that at 420 nm was obtained. The relative sensitivity data was converted into a numerical form by the following equation.

(sensitivity at 370 nm/sensitivity at 420 nm)×100 (%)

TABLE 2

| Sample | Surfactant Contained in 16-th layer | Relative sensitivity (370 nm)/(420 nm) (%) | Static fog | Crawling characteristic | Remark |
|---|---|---|---|---|---|
| 001 | W-1 | 75 | X | 100 | Comp. |
| 002 | W-1 | 69 | Δ | 112 | Comp. |
| 003 | W-1 | 58 | Δ | 122 | Comp. |
| 004 | W-1 | 45 | Δ | 151 | Comp. |
| 005 | W-1 | 20 | ⊙ | 199 | Comp. |
| 006 | W-6 | 56 | Δ | 131 | Comp. |
| 007 | W-6 | 22 | ⊙ | 211 | Comp. |
| 008 | FS-201 | 74 | X | 60 | Comp. |
| 009 | FS-201 | 69 | ○ | 61 | Inv. |
| 010 | FS-201 | 58 | ⊙ | 62 | Inv. |
| 011 | FS-201 | 23 | ⊙ | 64 | Inv. |
| 012 | FS-204 | 76 | X | 72 | Comp. |
| 013 | FS-204 | 68 | ○ | 73 | Inv. |
| 014 | FS-204 | 56 | ○ | 76 | Inv. |
| 015 | FS-204 | 25 | ⊙ | 78 | Inv. |
| 016 | FS-240 | 73 | X | 89 | Comp. |
| 017 | FS-240 | 57 | ○ | 90 | Inv. |
| 018 | FS-241 | 74 | X | 82 | Comp. |
| 019 | FS-241 | 68 | ○ | 83 | Inv. |
| 020 | FS-241 | 59 | ○ | 83 | Inv. |
| 021 | FS-241 | 42 | ⊙ | 85 | Inv. |
| 022 | FS-241 | 21 | ⊙ | 84 | Inv. |
| 023 | FS-319 | 75 | X | 87 | Comp. |
| 024 | FS-319 | 68 | ○ | 87 | Inv. |
| 025 | FS-319 | 58 | ○ | 89 | Inv. |
| 026 | FS-319 | 41 | ⊙ | 90 | Inv. |
| 027 | FS-319 | 20 | ⊙ | 91 | Inv. |

⊙: no fogging,
○: fogging in extremely slight degree,
Δ: fogging slightly,
X: fogging in high degree.

Results of charge conditioning capability test and high speed coatability test with respect to the samples 001 to 027 are listed in Table 2. It is apparent from Table 2 that in the Comparative Examples, increasing the use amount of ultraviolet absorber for enhancing the static resistance to thereby realize the spectral sensitivity distribution of the present invention results in poor high speed coatability while in the present invention, excellent charge conditioning capability can be realized without detriment to high speed coatability, namely, both of the desired properties are simultaneously attained.

EXAMPLE 2

A support used in this example was formed by the following method.

(i) First Layer and Undercoat Layer

Glow discharge was performed on the two surfaces of a 90-μm thick polyethylenenaphthalate support at a processing ambient pressure of 26.7 Pa, an $H_2O$ partial pressure in the ambient gas of 75%, a discharge frequency of 30 kHz, an output of 2,500 W, and a processing intensity of 0.5 kV·A·min/m$^2$. One surface (back surface) of this support was coated with 5 mL/m$^2$ of a coating solution having the following composition as a first layer by using a bar coating method described in JP-B-58-4589, the disclosure of which is incorporated herein by reference.

Conductive fine-grain dispersion 50 parts by weight (a water dispersion having an $SnO_2/Sb_2O_5$ grain concentration of 10%, a secondary aggregate having a primary grain size of 0.005 μm and an average grain size of 0.05 μm)

| | |
|---|---|
| Gelatin | 0.5 parts by weight |
| Water | 49 parts by weight |
| Polyglycerolpolyglycidyl ether | 0.16 parts by weight |
| Poly(polymerization degree 20) oxyethylenesorbitanmonolaurate | 0.1 part by weight |

In addition, after the first layer was formed by coating; the support was wound on a stainless-steel core 20 cm in diameter and heated at 110° C. (Tg of PEN support: 119° C.) for 48 hr so as to be given thermal hysteresis, thereby performing annealing. After that, the side (emulsion surface side) of the support away from the first layer side was coated with 10 mL/m$^2$ of a coating solution having the following composition as an undercoat layer for emulsions, by using a bar coating method.

| | |
|---|---|
| Gelatin | 1.01 parts by weight |
| Salicylic acid | 0.30 parts by weight |
| Resorcin | 0.40 parts by weight |
| Poly(polymerization degree 10) oxyethylenenonylphenyl ether | 0.11 parts by weight |
| Water | 3.53 parts by weight |
| Methanol | 84.57 parts by weight |
| n-Propanol | 10.08 parts by weight |

Furthermore, second and third layers to be described later were formed in this order on the first layer by coating. Subsequently, the opposite side was coated with multiple layers of a color negative light-sensitive material having a composition to be described later, thereby making a transparent magnetic recording medium having silver halide emulsion layers.

(ii) Second Layer (Transparent Magnetic Recording Layer)

(1) Dispersion of Magnetic Substance 1,100 parts by weight of a Co-deposited γ-$Fe_2O_3$ magnetic substance (average long axis length: 0.25 μm, $S_{BET}$: 39 m$^2$/g, Hc: 6.56×10$^4$ A/m, σs: 77.1 Am$^2$/kg, σr: 37.4 Am$^2$/kg), 220 parts by weight of water, and 165 parts by weight of a silane coupling agent [3-(poly(polymerization degree 10)oxyethynyl)oxypropyl trimethoxysilane] were added and well kneaded for 3 hr by an open kneader. This coarsely dispersed viscous solution was dried at 70° C. for 24 hr to remove water and heated at 110° C. for 1 hr to form surface-treated magnetic grains.

These grains were again kneaded for 4 hr by the following formulation by using an open kneader.

| | |
|---|---|
| Above-mentioned surface-treated magnetic grains | 855 g |
| Diacetylcellulose | 25.3 g |
| Methylethylketone | 136.3 g |
| Cyclohexanone | 136.3 g |

The resultant material was finely dispersed at 2,000 rpm for 4 hr by the following formulation by using a sand mill (1/4 G sand mill). Glass beads 1 mm in diameter were used as media.

| | |
|---|---|
| Above-mentioned kneaded solution | 45 g |
| Diacetylcellulose | 23.7 g |
| Methylethylketone | 127.7 g |
| Cyclohexanone | 127.7 g |

Furthermore, magnetic substance-containing intermediate solution was formed by the following formulation.

(2) Formation of Magnetic Substance-Containing Intermediate Solution

| | |
|---|---|
| Above-mentioned magnetic substance finely dispersed solution | 674 g |
| Diacetylcellulose solution (solid content 4.34%, solvent: methylethylketone/cyclohexanone = 1/1) | 24,280 g |
| Cyclohexanone | 46 g |

These materials were mixed, and the mixture was stirred by a disperser to form a "magnetic substance-containing intermediate solution".

An α-alumina polishing material dispersion of the present invention was formed by the following formulation.

(a) Sumicorundum AA-1.5 (average primary grain size 1.5 μm, specific surface area 1.3 m$^2$/g)

| Formation of grain dispersion | |
|---|---|
| Sumikorandom AA-1.5 | 152 g |
| Silane coupling agent KBM 903 (manufactured by Shin-Etsu Silicone) | 0.48 g |
| Diacetylcellulose solution (solid content 4.5%, solvent: methylethylketone/cyclohexanone = 1/1) | 227.52 g |

The above formulation was finely dispersed at 800 rpm for 4 hr by using a ceramic-coated sand mill (¼ G sand mill). Zirconia beads 1 mm in diameter were used as media.

(b) Colloidal Silica Grain Dispersion (Fine Grains)

"MEK-ST" manufactured by Nissan Chemical Industries, Ltd. was used.

"MEK-ST" was a colloidal silica dispersion containing methylethylketone as a dispersion medium and having an average primary grain size of 0.015 μm. The solid content is 30%.

(3) Formation of Second Layer Coating Solution

| | |
|---|---|
| Above-mentioned magnetic substance-containing intermediate solution | 19,053 g |
| Diacetylcellulose solution (solid content 4.5%, solvent: methylethylketone/cyclohexanone = 1/1) | 264 g |
| Colloidal silicon dispersion "MEK-ST" [dispersion b] (solid content 30%) | 128 g |
| AA-1.5 dispersion [dispersion a] | 12 g |
| Millionate MR-400 (manufactured by Nippon Polyurethane K.K.) diluted solution (solid-content 20%, diluent solvent: methylethylketone/cyclohexanone = 1/1) | 203 g |
| Methylethylketone | 170 g |
| Cyclohexanone | 170 g |

A coating solution formed by mixing and stirring the above materials was coated in an amount of 29.3 mL/m$^2$ by using a wire bar. The solution was dried at 110° C. The thickness of the dried magnetic layer was 1.0 $\mu$m.

(iii) Third Layer (Higher Fatty Acid Ester Slipping Agent-Containing Layer)

(1) Formation of Undiluted Dispersion

A solution A presented below was dissolved at 100° C. and added to a solution B. The resultant solution mixture was dispersed by a high-pressure homogenizer to form an undiluted dispersion of a slipping agent.

| | |
|---|---|
| Solution A | |
| Compound below $C_6H_{13}CH(OH)(CH_2)_{10}COOC_{50}H_{101}$ | 399 parts by weight |
| Compound below $n\text{-}C_{50}H_{101}O(CH_2CH_2O)_{16}H$ | 177 parts by weight |
| Cyclohexanone | 830 parts by weight |
| Solution B | |
| Cyclohexanone | 8,600 parts by weight |

(2) Formation of Spherical Inorganic Grain Dispersion

A spherical inorganic grain dispersion [c1] was formed by the following formulation.

| | |
|---|---|
| Isopropyl alcohol | 93.54 parts by weight |
| Silane coupling agent KBM903 (manufactured by Shin-Etsu Silicone) compound 1-1: $(CH_3O)_3S_1—(CH_2)_3—NH_2$) | 5.53 parts by weight |
| W-5 | 2.93 parts by weight |
| SEAHOSTAR KEP50 | 88.00 parts by weight |

(amorphous spherical silica, average grain size 0.5 $\mu$m, manufactured by NIPPON SHOKUBAI Co., Ltd.)

The above formulation was stirred for 10 min, and the following was further added.

Diacetone alcohol 252.93 parts by weight

Under ice cooling and stirring, the above solution was dispersed for 3 hr by using the "SONIFIER450 (manufactured by BRANSON K.K.)" ultrasonic homogenizer, thereby completing the spherical inorganic grain dispersion c1.

(3) Formation of Spherical Organic Polymer Grain Dispersion

A spherical organic polymer grain dispersion [c2] was formed by the following formulation.

XC99-A8808 (manufactured by TOSHIBA SILICONE K.K., spherical crosslinked polysiloxane grain,

| | |
|---|---|
| average grain size 0.9 $\mu$m) | 60 parts by weight |
| Methylethylketone | 120 parts by weight |
| Cyclohexanone | 120 parts by weight |

(solid content 20%, solvent: methylethylketone/cyclohexanone ~1/1)

Under ice cooling and stirring, the above solution was dispersed for 2 hr by using the "SONIFIER450 (manufactured by BRANSON K.K.)" ultrasonic homogenizer, thereby completing the spherical organic polymer grain dispersion c2.

(4) Formation of Third Layer Coating Solution

The following components were added to 542 g of the aforementioned slipping agent undiluted dispersion to form a third layer coating solution.

| | |
|---|---|
| Diacetone alcohol | 5,950 g |
| Cyclohexanone | 176 g |
| Ethyl acetate | 1,700 g |
| Above-mentioned SEEHOSTA KEP50 dispersion [c1] | 53.1 g |
| Above-mentioned spherical organic polymer grain dispersion [c2] | 300 g |
| FC431 (manufactured by 3M K.K., solid content 50%, solvent: ethyl acetate) | 2.65 g |
| BYK310 (manufactured by BYK Chemi Japan K.K., solid content 25%) | 5.3 g |

The above third layer coating solution was coated in an amount of 10.35 mL/m$^2$ on the second layer, dried at 110° C., and further dried at 97° C. for 3 min.

4) Coating of Light-Sensitive Layers

The opposite side of the back layers obtained as above was coated with a plurality of layers having the compositions of Samples 001 to 027 to make a color negative film.

Each of the samples was wrought into format for Advanced Photo System, placed in a dedicated cartridge and charged in a camera. The same tests and evaluation as in Example 1 were carried out, and the same satisfactory results as in Example 1 were obtained.

What is claimed is:

1. A silver halide color photographic lightsensitive material comprising a support and, superimposed thereon, at least one blue-sensitive layer, at least one green-sensitive layer, at least one red-sensitive layer and at least one non-lightsensitive layer, wherein at least one fluorinated surfactant represented by the following general formula (A) is contained and wherein a spectral sensitivity ratio at 370 nm as compared to that at 420 nm, which imparts the same density as that of the sensitivity at 420 nm in the spectral sensitivity distribution of the blue-sensitive layer, is 60% or less:

General formula (A)

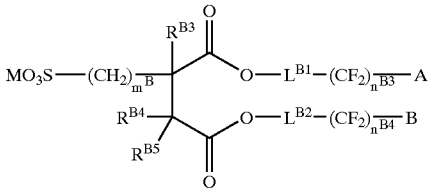

in the general formula (A), each of $R^{B3}$, $R^{B4}$ and $R^{B5}$ independently represents a hydrogen atom or a substituent; each of A and B independently represents a fluorine atom or a hydrogen atom; each of $n^{B3}$ and $n^{B4}$ is independently an integer of 4 to 8; each of $L^{B1}$ and $L^{B2}$ independently represents a substituted or unsubstituted alkylene group, a substituted or unsubstituted alkyleneoxy group, or a bivalent connecting group composed of a substituted or unsubstituted alkylene group combined with a substituted or unsubstituted alkyleneoxy group; $m^B$ is 0 or 1; and M represents a cation.

2. A silver halide color photographic lightsensitive material comprising a support and, superimposed thereon, at least one blue-sensitive layer, at least one green-sensitive layer, at least one red-sensitive layer and at least one non-lightsensitive layer, wherein at least one fluorinated surfactant represented by the following general formula (A) is contained and wherein a spectral sensitivity ratio at 370 nm as compared to that at 420 nm, which imparts the same density as that of the sensitivity at 420 nm in the spectral sensitivity distribution of the blue-sensitive layer, is 50% or less:

General formula (A)

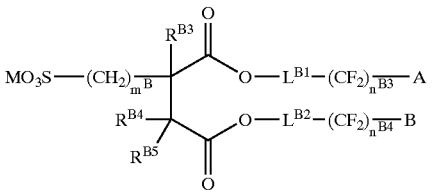

in the general formula (A), each of $R^{B3}$, $R^{B4}$ and $R^{B5}$ independently represents a hydrogen atom or a substituent; each of A and B independently represents a fluorine atom or a hydrogen atom; each of $n^{B3}$ and $n^{B4}$ is independently an integer of 4 to 8; each of $L^{B1}$ and $L^{B2}$ independently represents a substituted or unsubstituted alkylene group, a substituted or unsubstituted alkyleneoxy group, or a bivalent connecting group composed of a substituted or unsubstituted alkylene group combined with a substituted or unsubstituted alkyleneoxy group; $m^B$ is 0 or 1; and M represents a cation.

3. The silver halide color photographic lightsensitive material according to claim 2, wherein the spectral sensitivity ratio is 30% or less.

4. The silver halide color photographic lightsensitive material according to claim 1, wherein it is in the form of a roll film.

5. The silver halide color photographic lightsensitive material according to claim 2, wherein it is in the form of a roll film.

* * * * *